US012097553B2

(12) United States Patent
Dooley et al.

(10) Patent No.: US 12,097,553 B2
(45) Date of Patent: Sep. 24, 2024

(54) INVESTMENT CASTING SHELL BINDERS AND COMPOSITIONS

(71) Applicant: REMET CORPORATION, Utica, NY (US)

(72) Inventors: Gavin Dooley, Rochester (GB); Grant Bradley, Ware (GB); John Stanley Paraszczak, Utica, NY (US); Manuel Guerra, Jr., Utica, NY (US)

(73) Assignee: REMET CORPORATION, Utica, NY (US)

( * ) Notice: Subject to any disclaimer, the term of this patent is extended or adjusted under 35 U.S.C. 154(b) by 721 days.

(21) Appl. No.: 17/270,130

(22) PCT Filed: Aug. 23, 2019

(86) PCT No.: PCT/GB2019/052376
§ 371 (c)(1),
(2) Date: Feb. 22, 2021

(87) PCT Pub. No.: WO2020/044026
PCT Pub. Date: Mar. 5, 2020

(65) Prior Publication Data

US 2021/0178458 A1 Jun. 17, 2021

(30) Foreign Application Priority Data

Aug. 30, 2018 (GB) ..... 1814136

(51) Int. Cl.

| | |
|---|---|
| ***B22C 1/26*** | (2006.01) |
| ***B22C 1/18*** | (2006.01) |
| ***B22C 1/22*** | (2006.01) |
| ***B22C 9/04*** | (2006.01) |

(52) U.S. Cl.
CPC ..... *B22C 1/26* (2013.01); *B22C 1/183* (2013.01); *B22C 1/2213* (2013.01); *B22C 1/222* (2013.01); *B22C 1/2226* (2013.01); *B22C 1/2266* (2013.01); *B22C 9/04* (2013.01)

(58) Field of Classification Search
CPC ..... B22C 1/26; B22C 1/183; B22C 1/2213; B22C 1/222; B22C 1/2226; B22C 1/2266; B22C 9/04; B22C 1/2293
See application file for complete search history.

(56) References Cited

U.S. PATENT DOCUMENTS

| | | | |
|---|---|---|---|
| 9,227,241 | B2 | 1/2016 | Bhattacharja |
| 2005/0194118 | A1 | 9/2005 | Wang et al. |
| 2008/0105401 | A1 | 5/2008 | Nakai et al. |
| 2012/0148736 | A1 | 6/2012 | Bhattacharja |

FOREIGN PATENT DOCUMENTS

| | | | | |
|---|---|---|---|---|
| CN | 1371311 | A | | 9/2002 |
| CN | 1711143 | A | | 12/2005 |
| CN | 102548928 | A | * | 7/2012 |
| CN | 103260791 | A | | 8/2013 |
| JP | 2018-65727 | A | * | 4/2018 |
| JP | 2018-065727 | A | | 4/2018 |
| JP | 2018-90454 | A | * | 6/2018 |
| WO | 2018/085560 | A1 | | 5/2018 |

OTHER PUBLICATIONS

International Search Report mailed Dec. 4, 2019 in International Patent Application No. PCT/GB2019/052376 (3 pages).
Written Opinion of the International Searching Dec. 4, 2019 in International Patent Application No. PCT/GB2019/052376 (6 pages).
Japanese Office Action dated May 23, 2023 for Japanese Patent Application No. 2021-536418 (2 pages in Japanese with English translation).
Chinese Search Report dated Oct. 21, 2021 for Chinese Patent Application No. 201980037635.X (2 pages).
Chinese First Office Action dated Nov. 2, 2021 for Chinese Patent Application No. 201980037635.X (6 pages in Chinese with English translation).
Chinese Second Office Action dated May 10, 2022 for Chinese Patent Application No. 201980037635.X (4 pages in Chinese with English translation).

* cited by examiner

*Primary Examiner* — Anthony J Green
(74) *Attorney, Agent, or Firm* — Smith, Gambrell & Russell, LLP

(57) ABSTRACT

Investment casting shell composition binders comprising hydrophilic fibrils having an average diameter between about 1 nm and about less than 1 μm can be used for the preparation of investment casting shell compositions or slurries. The investment casting shell binders and compositions can be used in an investment casting process to produce investment casting shells with improved shell build thickness and strength.

14 Claims, 15 Drawing Sheets

INVESTMENT CASTING SHELL BINDERS AND COMPOSITIONS

The present invention relates to investment casting shell composition binders, investment casting shell compositions and methods for the preparation thereof. The present invention also relates to investment casting shells and investment casting methods for creating an article. The present invention also relates to kits for preparing investment casting compositions.

Investment casting, also known as lost wax, lost pattern or precision casting, is a process for producing metal articles.

The process typically involves the steps of: (1) preparing a disposable preform of the article (e.g. formed of wax); (2) building a ceramic casting shell around the preform; (3) removing the disposable preform (e.g. dewaxing); (4) sintering the casting shell; (5) pouring molten metal into the casting shell; (6) allowing the metal to cool within the casting shell; and (7) removing the casting shell.

Suitable disposable materials for the preform in step (1) include any material that will melt, vaporise or burn whilst leaving the casting shell intact. Wax is typically used, although polystyrene and certain polymers may also be used.

The ceramic casting shell in step (2) is typically formed around the disposable preform pattern by dipping the preform into an investment casting shell slurry to form one or more shell layers on the preform. Typically, an investment casting shell slurry is formed from a mixture of refractory materials and binders. The refractory material can be comprised of alumina ($Al_2O_3$), silica ($SiO_2$), zircon ($ZrSiO_4$), aluminosilicate ($Al_2SiO_5$). The binders can be alcohol- or water-based, and commonly comprise colloidal silica or ethyl silicate. Typically, slurry compositions for investment casting shells comprise 75-80% of refractory material and 20-25% binders.

Each slum coating is usually followed with a stucco coating to complete a shell layer. Once the shell layers have been applied, the green investment casting shell is allowed to air dry. These steps are repeated to build successive layers until the casting shell has the desired thickness.

Removal of the disposable preform in step (3), e.g. dewaxing, is commonly achieved by steam autoclaving or flash firing. During this step, the disposable preform is melted, vaporised or burnt away leaving the green shell mould having a negative imprint of the article.

Sintering of the shell in step (4) can be initiated by pressure or by firing. However, firing is conventionally used. Sintering fuses the shell into a denser mass, lowers the permeability and effectively increases the shell strength.

The fired shell mould is then filled with molten metal in step (5). This can be achieved using a variety of methods including gravity filling, pressure filling, vacuum filling and/or filling by centrifugal force. Once the metal has cooled (step (6)), the casting shell is broken apart leaving the casted metal article (step (7)).

Investment casting shells tend to be weak and are prone to breakage during the multi-stage investment casting process. For example, shell failure typically occurs at step (3) as the disposable material expands into the shell and at step (5) when molten metal is poured into the fired shell, as well as during handling as the shell is moved between equipment from one step to another.

Shell strength can be improved by increasing the number of layers of slurry and stucco applied, thereby increasing the shell thickness. However, each additional slurry coat increases the length of the investment casting process, as each layer must be dried sufficiently before another layer is formed on top. The increase in material resource also increases the cost of the process.

A first aspect of the invention provides an investment casting shell composition binder, the binder comprising hydrophilic fibrils having an average diameter between about 1 nm and about 1 μm.

In some embodiments, the hydrophilic fibrils have an average diameter between about 1 nm to less than about 1 μm, between about 10 nm to less than about 1 μm, between about 20 nm to less than about 1 μm, between about 10 nm and about 900 nm, between about 20 nm to about 100 nm, between about 50 nm to about 500 nm, between about 50 nm to about 400 nm, between about 50 nm to about 350 nm, between about 100 nm to about 400 nm, between about 100 nm to about 350 nm, between about 100 nm to 300 nm, and combinations of end points thereof. In some embodiments, the hydrophilic fibrils have an average diameter less than about 1 μm, less than about 900 nm, less than about 500 nm, less than about 400 nm, less than about 300 nm.

In some embodiments, the hydrophilic fibrils have an average length of between about 100 nm to about 100 μm, between about 500 nm to about 100 μm, between about 10 μm to about 100 μm. The hydrophilic fibrils may have an average length of between about 500 nm to about 4 μm, or between about 1 μm and about 3 μm.

In some embodiments, the hydrophilic fibrils have an aspect ratio (length to width ratio) of 15 or above, 20 or above, 25 or above, 50 or above. The hydrophilic fibrils may have an aspect ratio of up to 300.

The term hydrophilic means an affinity for water. The hydrophilicity of the fibrils may be determined by the molecular structure of the fibrils. For example, the hydrophilic fibrils may comprise —OH groups available for hydrogen bond donation. The hydrophilic fibrils may further be insoluble in water.

Surprisingly, it was found that investment casting shells prepared from compositions comprising hydrophilic fibrils in the binder resulted in shells with consistently thicker coating layers (e.g., up to 30% thicker) and increased strength (e.g., up to 40% more force required to break the shell). Furthermore, the resulting investment casting shells were found to have increased permeability. The combined strength and permeability was a surprising result, since an increase in shell permeability is usually associated with a decrease in shell strength.

"Permeability" in the context of the present invention refers to the rate at which gas passes through the shell. Low permeability can cause air to become trapped inside the shell, which can prevent molten metal from filling the shell cavity, and can also cause the shell to crack at high temperatures.

The term "porosity" in the context of the present invention refers to the fraction of empty (void) spaces in the shell. A shell with high porosity may not necessarily have high permeability.

In some embodiments, the hydrophilic fibrils comprise cellulose fibrils.

In some embodiments, the hydrophilic fibrils may be derived from a natural source, for example, from natural fibres produced by plants, animal or geological processes. Natural fibres include cellulose, chitin, chitosan, collagen, keratin and tunican.

In some embodiments, the hydrophilic fibrils, e.g. cellulose fibrils, are derived from a raw material selected from the group consisting of: trees, vegetables, sugar beets, citrus fruits and combinations thereof.

The hydrophilic fibres may be comprised of or provided as fibrillated fibres.

For example, the hydrophilic fibrils may be derived from a fibre or fibres that have been subjected to fibrillation. The term "fibrillation" refers to the splitting of fibres into fibrils. Fibrillation of a fibre, which may be a natural fibre, synthetic fibre or a regenerated fibre, causes external and internal segments of the fibre surface to partially detach from the main fibre structure. The fibrils may be attached by one segment to the main fibre structure. The fibrils may attach to other fibrils to form a three dimensional network. Fibrillation may be achieved using any known technique, for example, mechanically or thermomechanically, chemically, or a combination thereof. Advantageously, the fibrils have a significantly greater combined surface area compared to the original fibres.

In alternative embodiments, the hydrophilic fibrils may be derived or formed synthetically, or by any other known method.

In some embodiments, the hydrophilic fibrils comprise microfibrillated cellulose (MFC). Microfibrillated cellulose (MFC), also known as cellulose nanofibres (CNF), nanocrystalline cellulose (NCC) or cellulose nanocrystals (CNC), is a cellulosic material comprising a three-dimensional network of fibrils having amorphous and crystalline regions. Through a fibrillation process (e.g. as described herein), the outer layers of cellulose fibres are stripped away exposing fibril bundles which are separated out to form a three-dimensional network of insoluble fibrils with a large surface area. The entangled cellulosic fibrils are known as microfibrillated cellulose (MFC).

In embodiments of the invention, the hydrophilic fibrils are non-ionic.

In embodiments of the invention, the hydrophilic fibrils are made from wood pulp from pine, preferably spruce.

In embodiments of the invention, the hydrophilic fibrils comprise cellulose that is unmodified compared to the cellulose in the feedstock used to make the hydrophilic fibrils.

In embodiments of the invention, the hydrophilic fibrils are made by breaking down wood pulp using enzymes and/or mechanical methods.

The terms "fibre" and "fibril" in the context of the present invention are distinguished by their size and aspect ratio. Fibres have diameters on the micro- to milli-scale, whereas fibrils have diameters on the nanometer scale, i.e. 1 nm to 1 μm. For example, pulped cellulose fibres typically have a diameter in the range 2 μm to 80 μm, and length in the range 0.005 mm to 10 mm. By contrast, microfibrillated cellulose (MFC) fibrils have diameters between 1 nm to 1 μm. Due to the complex three-dimensional structure of MFC, it is difficult to define the length of each individual fibril. Each fibril forms a network with other fibrils, which together can form lengths of several micrometers.

In some embodiments, the hydrophilic fibrils are present in an amount from about 0.1 wt % to about 20 wt % based on the total mass of the binder, preferably from about 0.1 wt % to about 5 wt % based on the total mass of the binder, from about 0.2 wt % to about 4 wt % based on the total mass of the binder, or 0.2 wt % to about 0.4 wt % based on the total mass of the binder. In some embodiments, the hydrophilic fibrils are present in an amount of at least about 0.2 wt % based of the total mass of the binder, at least about 0.25 wt % based of the total mass of the binder. In some embodiments, the hydrophilic fibrils are present in an amount at most about 0.5 wt % based on the total mass of the binder, at most about 0.45 wt % based on the total mass of the binder or at most about 0.4% based on the total mass of the binder.

The binder may further comprise colloidal silica. In some embodiments, the binder may comprise ethyl silicate. Advantageously, silica particles from the colloid may form hydrogen bonds with the hydrophilic fibrils in the binder. This is thought to contribute to the formation of a robust ceramic matrix for investment casting shells, thus improving shell build and strength.

The binder may further comprise at least one additional polymer. For example, the at least one additional polymer comprises one or more monomers selected from the list consisting of: acrylic acid, acrylic esters, methacrylic acid, methacrylic esters, styrene, butadiene, vinyl chloride, vinyl acetate, and combinations thereof. In some embodiments, the at least one additional polymer comprises styrene.

Advantageously, styrene polymers have been found to provide increased green strength, i.e. breakage resistance, by imparting flexibility to the shell. In some embodiments, the at least one additional polymer comprises a styrene butadiene copolymer. In alternative embodiments, the at least one additional polymer comprises a styrene acrylate copolymer. Advantageously, styrene polymers may form hydrogen bonds with the hydrophilic fibrils in the binder, thus improving shell build thickness and strength.

The at least one additional polymer may be present in an amount from about 0 to about 20 wt % based on the total mass of the binder, about 5 to about 15 wt/o based on the total mass of the binder, or about 10 to about 15 wt % based on the total mass of the binder. In one embodiment, the at least one additional polymer is present in an amount of about 12 wt % based on the total mass of the binder.

The binder may further comprise at least one additional agent selected from the list consisting of: a wetting agent, an anti-foam agent, a pH modifier, a bactericide and a fungicide.

The term "wetting agent", also known as a surfactant, refers to a chemical substance that increases the spreading properties of a liquid by lowering surface tension. Wetting agents can be used in investment casting shell slurries to improve adhesion between the slurry and the wax pattern.

The term "anti-foam agent", also known as a defoamer, refers to a substance that reduces or prevents the formation of foam in a liquid. Anti-foam agents can be used in investment shell slurries to reduce the formation of bubbles which improves adhesion of the slurry to the wax pattern and improves the surface finish of the final product.

The pH of the binder can have a significant effect on the binder properties. For example, colloidal silica particles are negatively charged with a pH around 10. At pH levels below 9.0, colloidal silica particles can start to gel, thus a pH of pH 9.4 or above is preferred. Thus, pH modifiers can be used to control the pH of the binder.

The term "bactericide", also referred to as a biocide, refers to a chemical substance that reduces or prevents growth of bacteria. The term "fungicide" refers to a chemical substance that reduces or prevents growth of fungi. Bacteria and fungal growth in an investment casting shell slurry can cause the pH to drop leading to gelation which shortens the shelf life of investment casting compositions and weakens the resulting shells.

A second aspect of the invention provides an investment casting shell composition comprising the binder described herein and a refractory component. The composition can be provided as a slurry. The term "slurry" refers to a semi-liquid mixture comprising solid particles suspended in a solvent. In the context of the present invention, an investment casting slurry refers to the composition that the disposable preform pattern is dipped in to form a layer around the preform to build the investment casting shell.

In some embodiments, the binder is present in the composition at a concentration of from 20 wt % to 40 wt % based on the total mass of the composition. The binder may be provided as a colloidal solution (sol) in water or alcohol.

In some embodiments, the hydrophilic fibrils in the binder are present in an amount from about 0.01 wt % to about 1 wt % based on the total mass of the composition, about 0.01 wt/o to about 0.5 wt % based on the total mass of the composition, about 0.05 wt % to about 0.2 wt % based on the total mass of the composition, or about 0.05 wt % to about 0.15 wt % based on the total mass of the composition.

Despite significantly increasing the viscosity of the slurry to a level expected to be unworkable, it was surprisingly found that MFC had a thixotropic effect and could be incorporated at levels higher than expected.

The refractory component may comprise at least one selected from the list consisting of: fused silica ($SiO_2$), aluminosilicate ($Al_2SiO_5$), alumina ($Al_2O_3$), zirconium silicate ($ZrSiO_4$), microsilica, zirconia ($ZrO_2$), zircon ($ZrSiO_4$), yttira ($Y_2O_3$), quartz, carbon and combinations thereof.

The refractory component may comprise fused silica of: mesh 120, mesh size 140, mesh 170, mesh 200, mesh 270, mesh 325, or combinations thereof.

In some embodiments, the refractory component comprises fused silica with particle size distribution comprising a d10 value in the range of about 5 μm to about 15 μm, a d50 value in the range of about 35 μm to about 55 μm, and a d90 value in the range of about 90 μm to about 110 μm, a D[3,2] value in the range from about 10 μm to about 15 μm and a D[4,3] value in the range from about 40 μm to about 60 μm The d10 value refers to the diameter at which 10% of particles are less than the given value, the d50 value refers to the diameter at which 50% of particles are less than the given value, and the d90 value refers to the diameter at which 90% of particles are less than the given value. D[3,2] refers to the surface mean diameter and D[4,3] refers to the volume mean diameter.

In an alternative embodiment, the refractory component comprises aluminosilicate. In some embodiments, the refractory component comprises calcined kaolin aluminasilicate.

In one embodiment, the refractory component comprises a particle size distribution comprising the parameters of d10 of about 9 μm, d50 of about 46 μm and d90 of about 99 μm, D[3,2] of about 12 μm and D[4,3] of about 57 μm.

In one embodiment, the refractory component comprises a particle size distribution comprising the parameters of d10 of about 5 μm, d50 of about 31 μm, d90 of about 99. D[3,2] of about 12 μm and D[4,3] of about 43 μm.

In an alternative embodiment, the refractory component comprises a wide distribution fused silica flour. Wide distribution fused silica flours may be prepared by combining an amount of fine silica particles with an amount of larger silica particles. For example, the wide distribution silica flour may be composed of between 80% to 90% of 50-80 mesh silica (average size approx. 200 microns), and between 10 to 20% of 120 mesh silica (average size approx. 125 microns).

The particle size distributions of silica mesh 200, silica mesh 270 and a wide distribution flour comprising 85% 50-80 mesh and 15% 120 mesh (EZ Cast™, Remet UK Ltd) are also shown in FIG. 15.

It was found that the use of a refractory component with a wide particle distribution in combination with the binder described herein resulted in investment casting shells with improved shell build and higher strength compared to using refractories having narrow particle size distributions.

A third aspect of the invention provides an investment casting shell prepared from the investment casting shell composition described herein.

A fourth aspect of the invention provides a method of preparing an investment casting shell composition, the method comprising: i) mixing hydrophilic fibrils in an aqueous solvent; (ii) adding the mixture in (i) to a container comprising colloidal silica to form a binder; (iii) optionally adding one or more additional agents comprising: a polymer, an anti-foam agent, a pH modifier, a bactericide and a fungicide to the binder; (iv) mixing the binder with a refractory component to form a slurry.

A fifth aspect of the invention provides an investment casting method for creating an article, the method comprising coating an expendable preform with at least one coat of an investment casting shell slurry, wherein at least one of the slurry coats comprises the investment casting shell composition described herein.

In some embodiments, the slurry coats in the second layer and above (e.g. back up layers) comprise the investment casting shell composition described herein. For example, the slurry coats may be formed by dipping the preform in the investment casting shell composition described herein. In some embodiments, the first slurry coat (e.g. prime coat) does not comprise the investment casting shell composition described herein—i.e. the first slurry coat comprises a different, known prime coat composition.

In some embodiments, the method further comprises stuccoing one or more of the at least one slurry coats, wherein a slurry coat and a stucco coat produced by the stuccoing create a shell layer, wherein each shell layer once dried is at least 1 mm thick, preferably at least 1.1 mm thick, more preferably at least 1.2 mm thick, even more preferably at least 1.3 mm thick. In some embodiments, the final layer of the investment casting shell mould does not comprise a stucco coat.

In some embodiments, the method comprises applying at least 2 layers, at least 3 layers, at least 4 layers, at least 5 layers, at least 6 layers of the investment casting shell composition. In some embodiments, the method comprises applying at most 7 layers, at most 6 layers, at most 5 layers, at most 4 layers, at most 3 layers of the investment casting shell composition.

The method may further comprise the step of drying each layer before applying a subsequent layer. The method may further comprise the step of drying the coated pre-form to produce a green investment casting shell.

Advantageously, the investment casting shell compositions of the present invention provide shells with thicker shell layers compared to conventional compositions and fewer layers are required to arrive at the same shell build thickness. Accordingly, the shell build time may be significantly reduced, thus providing time and cost savings. The investment casting shell method of the invention further provides investment casting shells with improved strength and versatility.

The method may further comprise the step of heating the green investment casting shell mould to produce a fired investment casting shell mould. The method may further comprise the step of replacing the expendable preform pattern with a molten material, for example, molten metal. The method may further comprise the step of allowing the molten material to solidify in the investment casting shell mould to produce an article.

The "prime coat" or prime layer refers to the first layer of the investment casting shell that is formed around the disposable preform pattern. The prime coat is formed by applying a coat of investment casting slurry to the preform, optionally followed by a stucco coat. The prime coat should have good adhesion to the disposable preform so that an accurate pattern mould is created and resistance to reaction with the molten metal during pouring. For this reason, the slurry for the prime coat may comprise a different composition to the slurry for the subsequent back-up and seal coats.

Alternatively, the prime coat may comprise the same composition as the back-up coat or seal coat. A solvent sometimes referred to as a "pattern wash" may be used to wash the wax pattern prior to applying the first slurry coat. The use of a pattern wash promotes adherence of the slurry to the wax surface by removing dirt or residual mould release agents which may have been left on the wax. The pattern wash may be petroleum based.

The term "back-up coat" or back-up layer refers to the layers of slurry that are applied on top of the prime coat to build up the structure of the investment casting shell. The back-up coats are formed by applying a coat of investment casting slurry to an underlying prime coat or back-up coat, optionally followed by a stucco coat. The term "seal coat" or seal layer refers to the final outer layer of the investment casting shell. The seal coat is formed by applying a coat of investment casting slurry on top of an underlying back-up coat. Stucco is usually not applied to the seal coat.

The term "stucco" refers to a material made of aggregates. The stucco may comprise: silica, alumina, zircon, aluminosilicate, mullite and/or chromite.

A sixth aspect of the invention provides a kit for preparing an investment casting shell comprising: the investment casting shell composition binder described herein; and a refractory component. Advantageously, the binder of the invention has good stability and shelf life and thus can be packaged and sold in a format ready for the end user to combine directly with a refractory component.

In particular, binders of the invention comprising MFC were found to have good chemical stability, for example, gelation of the binder component of the slurry did not occur after at least 71 days when subjected to an accelerated gel test (held in an airtight bottle in an oven at 60° C.). The binders comprising MFC were also found to have good physical stability and maintained a good distribution without separation. This is in contrast to binders comprising macro scale fibres where separation could be observed after just a few hours.

Performance Testing of Investment Casting Shells

During an investment casting process, the investment casting shell is subjected to high internal pressures and thermal stress. For example, the shell must have sufficient green strength to withstand wax removal, sufficient fired strength to withstand the pressure of the cast metal, high thermal shock resistance to prevent cracking during metal pouring, high chemical stability, low reactivity with metals being cast and sufficient permeability and thermal conductivity to maintain adequate thermal transfer through the mould.

Green shell testing is performed to establish the ability of the shell to withstand handling, as well as the process of removing the disposable preform (e.g. "dewaxing"). As the preform, e.g. wax, begins to melt, it also expands into the shell, thus the shell must be sufficiently strong to maintain its shape and strength for the next stage of the process. The flexibility imparted by the polymer component of the binders of the invention is particularly beneficial at this stage of the lost wax cast process.

Hot shell testing (i.e. where the shell is tested after firing at around 1000° C.) is performed to replicate the state of the shell during the lost wax process when molten metal is poured into vacated shell. This stage is usually carried out in a furnace at temperatures of around 1000° C., at which temperature any organic matter contained in the shell is burned out. The shell must be strong enough to withstand high temperatures within the furnace, as well as mechanical distortion caused by impact as the molten metal is poured into the shell.

Cold shell testing is performed to replicate the condition of the shell at the end of the lost wax casting process, once the shell has cooled and the enclosed metal has solidified. The shell at this stage is at the end of its life so no longer requires high strength and will ideally be more brittle so that it can be broken away from the metal pattern cast more readily.

It will be appreciated that mechanical testing of shells is particularly important to establish how investment casting shells will perform during an investment casting process.

Modulus of rupture (MOR), also known as flexural strength, bend strength or fracture strength, is defined as the stress in a material as it is bent just before it yields (breaks). MOR is usually measured in megapascals (MPa), i.e. the force (N) required to break 1 $m^2$ of the material. The general formula for MOR is: $MOR=3WL/2BD^2$, wherein W is load, L is pan, B is width and D is thickness. Therefore, theoretically, the strength (MOR) of the shell material should be independent of thickness and only a property of the materials and processing involved.

The force of break, also known as break strength, is defined as the compressive load required to fracture a material. This measurement is particularly important for investment casting shells, as it indicates the load that the shell can withstand before breaking. A high force of break is critical to prevent leaks or failure when molten metal is poured into the shell for casting.

Due to the different thicknesses, although MOR is a measure per cross sectional area, due to the propensity for flaws to be present in thicker samples, MOR can appear lower for samples of the same material. Thus, the force of break is a more accurate measure of the strength of casting shells.

The invention is described with reference to the accompanying drawings which:

EXAMPLES

Example 1—Investment Casting Shell Composition Formulations

1.1 Formulations for Shell Room Trials

TABLE 1

Figure 1:
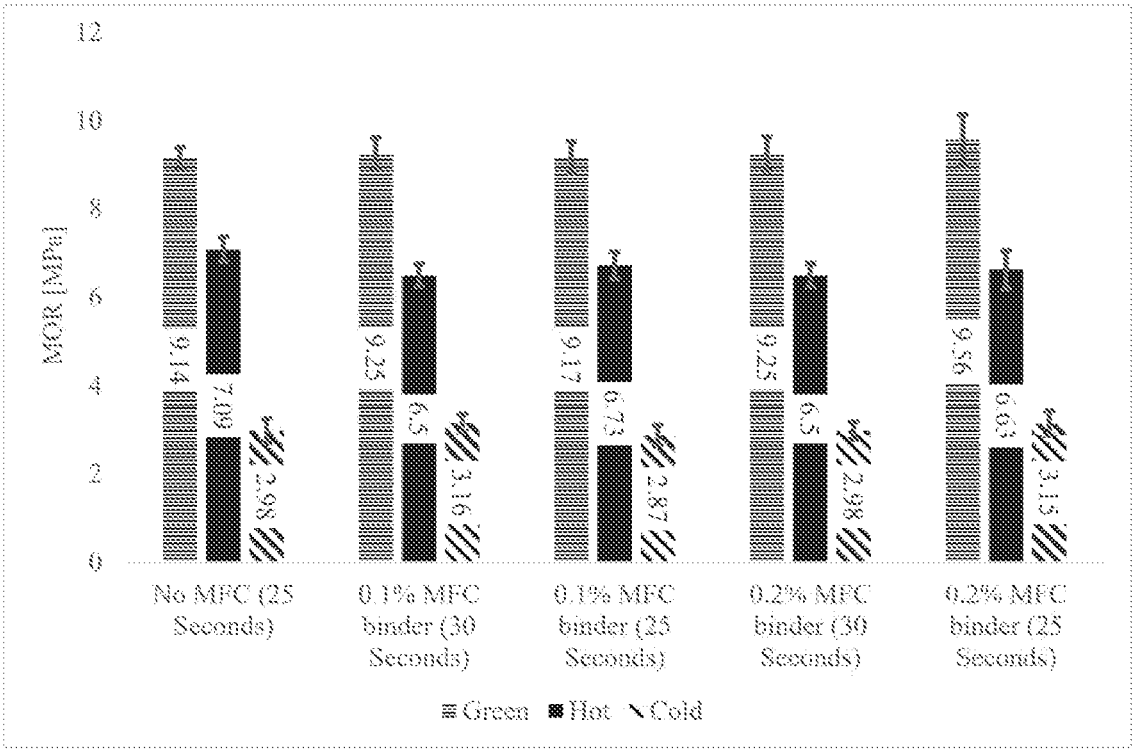
FIG. 1 is a graph showing modulus of rupture (MOR) results for shells prepared from slurries comprising 0.1% and 0.2% MFC as binder at two different viscosities, compared to conventional shells prepared from slurries comprising no MFC [n=10]

| Ingredients | Conventional (no MFC)/kg | Example formulation 1 (0.1% MFC)/kg | Example formulation 2 (0.2% MFC)/kg |
|---|---|---|---|
| 200 mesh fused silica (Imerys Fused Minerals) | 91 | 91 | 91 |
| Colloidal silica (Remasol ® SP-30; Grace GMBH) | 45.5 | 45.5 | 45.5 |
| Styrene butadiene copolymer (Lipaton SB 5843; Synthomer plc) * | 6.5 | 6.5 | 6.5 |
| Wetting agent, ethoxylated akyl acid phosphate (Victawet ® 12, ILCO Chemie) | 0.113 | 0.113 | 0.113 |
| Anti-foaming agent, polysiloxane dispersion (Burst 100; Remet Corporation) ^ | 0.091 | 0.091 | 0.091 |
| Microfibrillated cellulose (Exilva ® P 01-V, 10% aqueous dispersion; Borregaard) | 0 | 0.552 | 1.104 |

* Lipaton SB 5843 may be replaced with an equal amount of Adbond ® BV (Remet Corporation).
^ Burst 100 may be replaced with an equal amount of Funnexol ® (Huntsman Textile Effect).

1.2 Formulations for Lab Scale Trials

1.2.1200 Mesh Fused Silica as Refractory

TABLE 2

| Ingredients | Conventional (no MFC)/kg | Example formulation 3 (0.3% MFC)/kg |
|---|---|---|
| 200 mesh fused silica (Imerys Fused Minerals) | 700 | 700 |
| Colloidal silica (Remasol ® SP-30; Grace GMBH) | 350 | 350 |
| Styrene butadiene copolymer | 50 | 50 |

TABLE 2-continued

| Ingredients | Conventional (no MFC)/kg | Example formulation 3 (0.3% MFC)/kg |
|---|---|---|
| (Lipaton SB 5843; Synthomer plc)* | | |
| Wetting agent (Wet-in ®; Remet Corporation) # | 10 | 10 |
| Anti-foaming agent (Burst 100; Remet Corporation) ^ | 2.5 | 2.5 |
| Microfibrillated cellulose (Exilval ® P 01-V, 10% concentration; Borregaard) | 0 | 12.4 |

*Lipaton SB 5843 may be replaced with an equal amount of Adbond ® BV (Remet Corporation).
^ Burst- 100 may be replaced with an equal amount of Fumexol ® (Huntsman Textile Effect).
Wet-in ® may be replaced with an equal amount of Victawet ® 12 (ILCO Chemie).

1.2.2 Wide Distribution Silica (WDS) as Refractory

TABLE 3

| Ingredients | Conventional (no MFC, WDS)/kg | Example formulation 4 (03% MFC; WDS)/kg |
|---|---|---|
| Fused silica (EZ Cast ™; Remet UK Ltd) | 700 | 700 |
| Colloidal silica (Remasol ® SP-30; Grace GMBH) | 350 | 350 |
| Styrene butadiene copolymer (Lipaton SB 5843; Synthomer plc) * | 50 | 50 |
| Wetting agent (Wet-in ®: Remet Corporation) # | 10 | 10 |
| Arni-foaming agent (Burst 100; Remet Corporation) ^ | 2.5 | 2.5 |
| Microfibrillated cellulose (Exilva ® P 01-V, 10% concentration; Borregaard) | 0 | 12.4 |

* Lipaton SB 5843 may be replaced with an equal amount of Adbond ® BV (Remet Corporation).
^ Burst 100 may he replaced with an equal amount of Fumexol ® (Huntsman Textile Effect).
Wet-int may be replaced with an equal amount of Victawet ® 12 (TECO Chemie),

1.3 Binder Formulation for Warehouse Scale Trials

TABLE 4

| Ingredients | Example formulation 5 (0.3% MFC)/kg |
|---|---|
| Colloidal silica (Remasol ® SP-30; Grace GMBH) | 192 |
| Styrene butadiene copolymer (Lipaton SB 5843; Synthomer plc)* | 19.2 |
| Deionised water | 19.2 |
| Biocide (Acticide ® MBS 50:501,2-Benzisothiazol-3(2H)-one:2-methyl-2H-isothiazol-3-one; Thor Specialities) | 1.2 |
| Anti-foaming agent (Burst 100; Remet Corporation) | 1.2 |
| Microfibrillated cellulose (Exilva ® P 01-V, 10% concentration; Borregaard) | 7.2 |

*Lipaton SB 5843 may be replaced with an equal amount of Adbond ® BV (Remet Corporation).
^ Burst 100 may he replaced with an equal amount of Fumexol ® (Huntsman Textile Effect).

1.4 Viscosity Adjustments

The viscosity of each test slurry was measured used a Zahn cup (#4). Timing was commenced as the sampling end of the cup broke the surface of the sample after dipping, and stopped when the first definitive break in the stream of slurry was observed at the base of the sampling cup.

Before testing, the viscosity of each slurry was adjusted to 25 seconds (unless otherwise specified). Viscosity adjustments were carried out by adding deionised water (to lower viscosity) or allowing water to evaporate from the slurry (to increase viscosity).

Example 2—Modulus of Rupture (MOR) Shell Build Thickness and Force of Break

2.1 Shell Room Trials (0.1% and 0.2% MFC Binder)

2.1.1 Sample Preparation

Example slurry formulations 1 and 2 were prepared as set out in Table 1. Each slurry was tested at a viscosity of 25 seconds and 30 seconds respectively.

Five wax bars (25 mm×150 mm) were dipped in pattern wash, rinsed with water and left to dry in a temperature controlled room (airflow 0.6 m/s; humidity 45% RH; temperature 25° C.). Each bar was then dipped in the test slurry composition following the dipping protocol set out in Table 5 to form a shell. A total of 9 slurry coats were applied to each wax bar. The first 8 coats were each followed by a stucco coat. Each layer (slurry+stucco) was left to dry for approximately 1 hour before applying a further coat on top. A prime coat was not applied to the wax patterns for shell testing.

TABLE 5

| Type of dip | Stucco used | Coats |
|---|---|---|
| Backup coat | Calcined kaolin aluminosilicate, 48% alumina (Remasil ® 50; 16-30 mesh; Remet UK Ltd) | 8 |
| Seal coat | None | 1 |

MOR, thickness and force of break measurements were carried out on each coated wax bar when green (air dried), hot (immediately after firing at 1000° C.) and cold (once cooled to room temperature after firing).

2.1.2 Method

Testing was carried out in accordance with BSI BS 1902-4.4:1995 and BS EN 993-6:1995.

Figure 2:
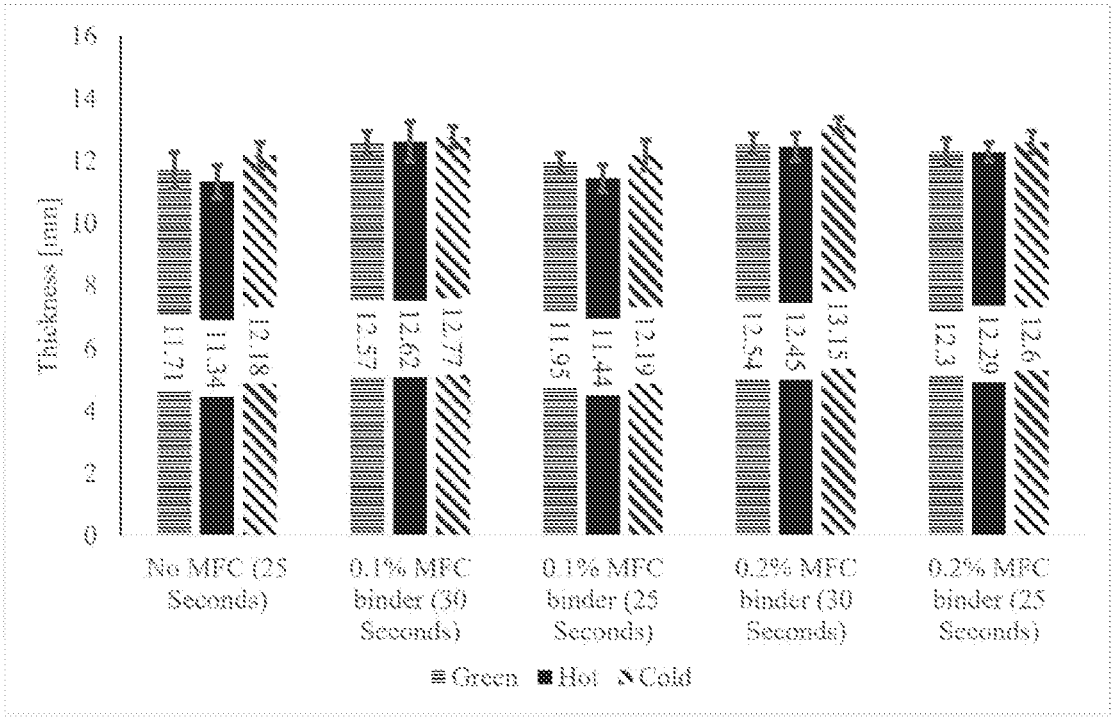
FIG. 2 is a graph comparing the shell thicknesses of shells prepared from slurries comprising 0.1% and 0.2% MFC as binder compared to conventional shells prepared from slurries comprising no MFC [n=10].

A flat, rectangular shell sample from the top or bottom of each wax bar was removed and used for MOR testing. The width was measured in two places and an average taken. Samples of the shell were tested to rupture in a three point bending test by placing the shell sample between on two support beams (fixed span), and applying a load uniformly from above the sample. The load at fracture was recorded and the surface area of the fracture was measured in two places and an average taken. MOR was calculated as follows: MOR=3×(load at rupture)×span)/(2×(width)×(thickness)$^2$ and the results are shown in FIG. 1. The shell thickness of each sample was measured and the results are shown in FIG. 2.

Figure 3:
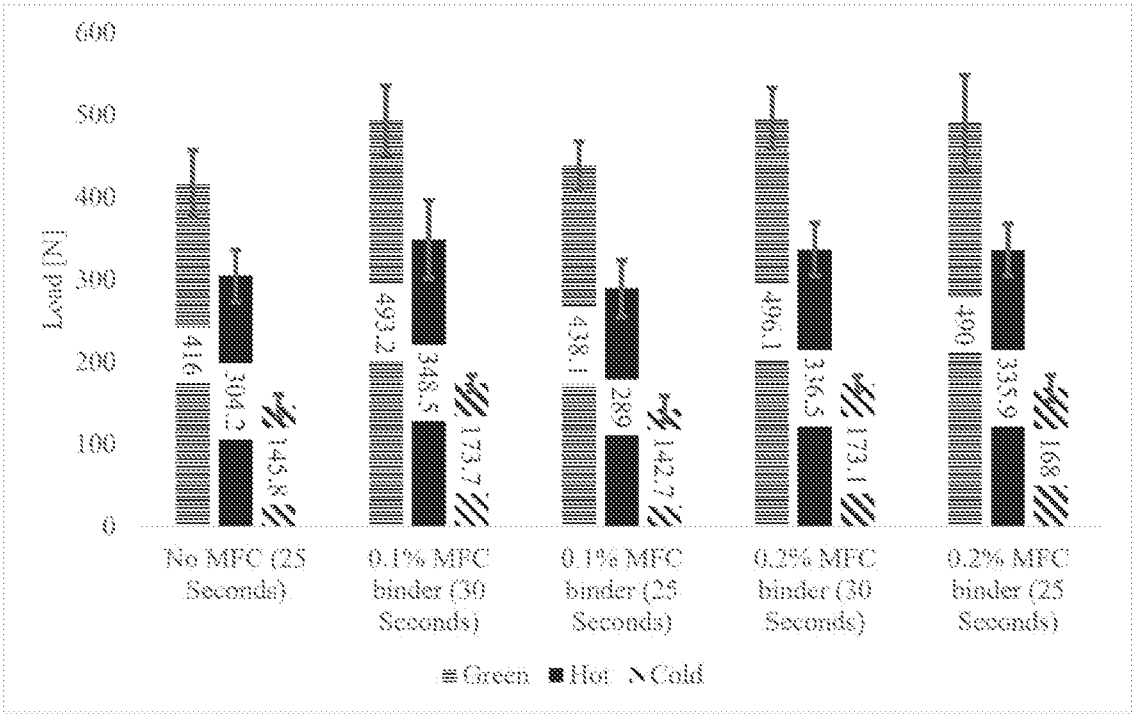
FIG. 3 is a graph showing force of break results for shells prepared from slurries comprising 0.1% and 0.2% MFC as binder compared to conventional shells prepared from slurries comprising no MFC [n=10]

Force of break testing was carried out on a Lloyd Instruments LRX tensile testing device (model TG18) fitted with a calibrated 2500N load cell. The force of break results are shown in FIG. 3.

The results show that the strengths for shells made from slurries comprising 0.1% and 0.2% MFC in the binder exhibited some improvement compared to the conventional slurry formulations with no MFC. In view of the results, further tests were carried out on slurry formulations comprising 0.3% of MFC.

2.2 Lab Scale Trials (0.3% MFC in Binder)

2.2.1 Sample Preparation

Example formulation 3 was prepared as set out in Table 2 to a viscosity of 25 seconds.

Five wax bars (25 mm×150 mm) were dipped in pattern wash, rinsed with water and left to dry in a temperature controlled room (airflow 0.6 m/s; humidity 45% RH; temperature 25° C.). Each bar was then dipped in the test slurry composition comprising 0.3% MFC (see Table 2) following the dipping protocol set out in Table 6 below to form a shell.

TABLE 6

| Type of dip | Stucco used | Conventional (no MFC) | Conventional (no MFC) | Example formulation 3 (0.3% MFC) | Example formulation 3 (0.3% MFC) |
|---|---|---|---|---|---|
| Backup coat | Calcined kaolin aluminosilicate, 48% alumina (Remasil ® 50; 16-30 mesh; Remet UK Ltd) | 8 | 5 | 8 | 5 |
| Seal coat | None | 1 | 1 | 1 | 1 |

The tests were carried out on each coated wax bar when green (air dried), hot (immediately after firing at 1000° C.) and cold (once cooled to room temperature after firing).

2.2.2 Results

Figure 4:
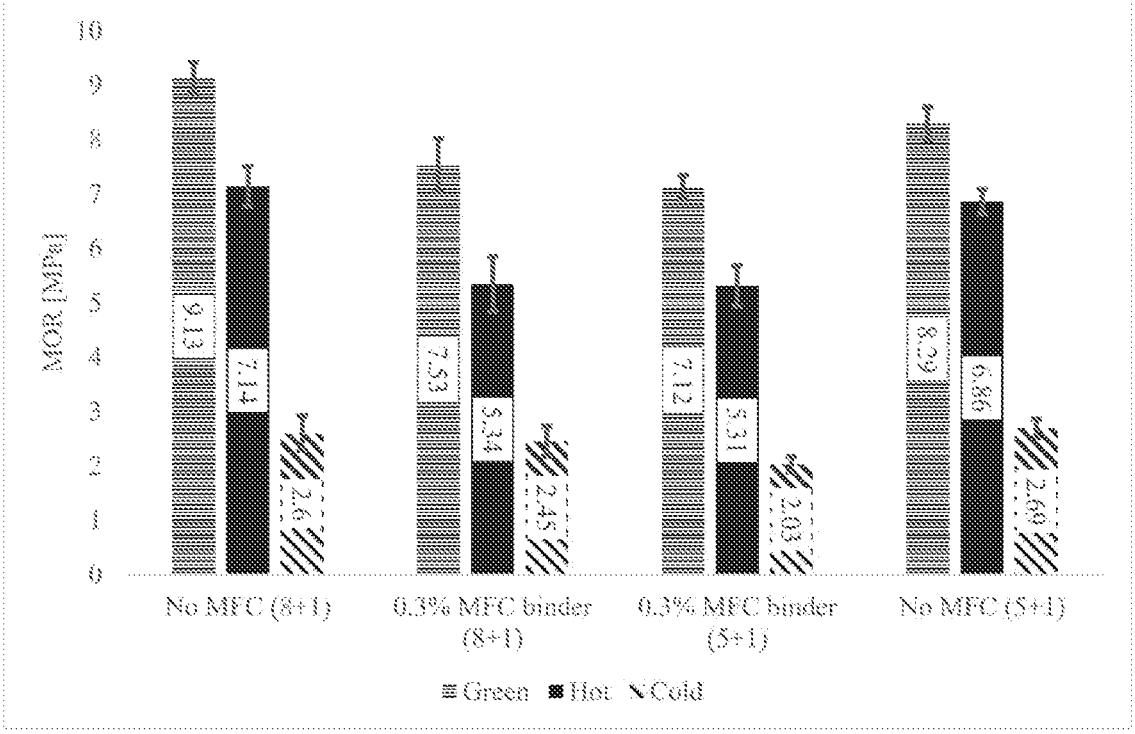
FIG. 4 is a graph showing modulus of rupture (MOR) results for shells comprising 6 or 9 shell layers prepared from slurries comprising 0.3% MFC as binder, compared to conventional shells prepared from slurries comprising no MFC [n=10]
Figure 5:
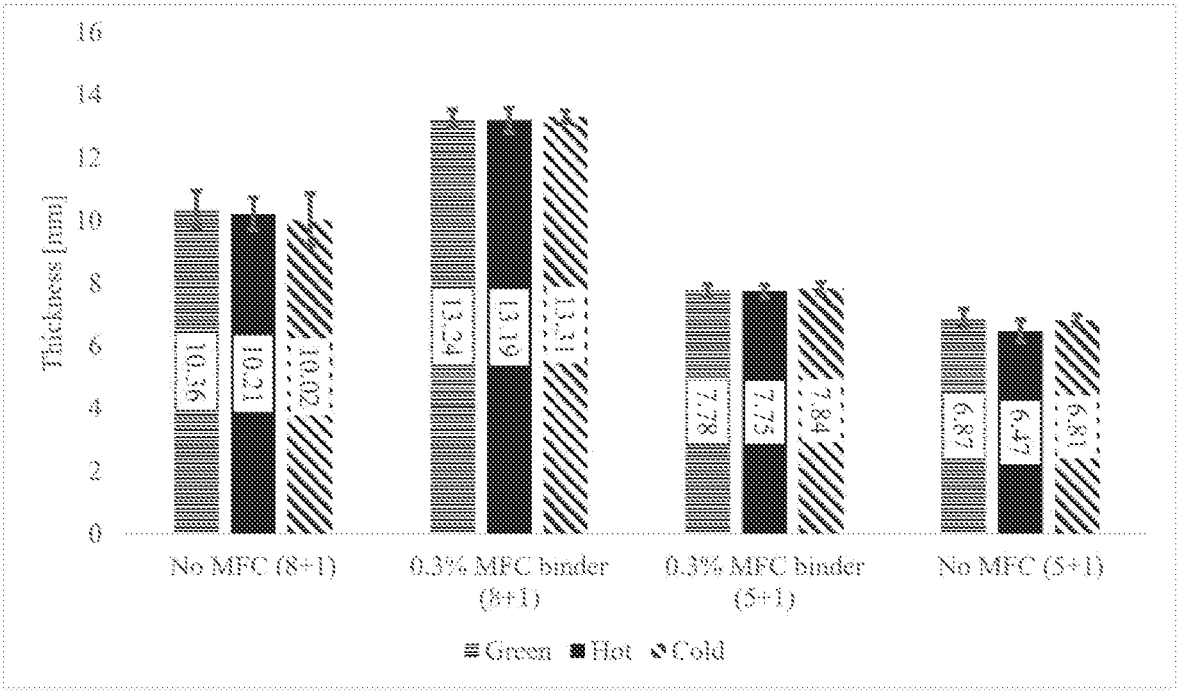
FIG. 5 is a graph comparing the shell thicknesses of shells comprising 6 or 9 shell layers prepared from slurries comprising 0.3% MFC as binder, compared to conventional shells prepared from slurries comprising no MFC [n=10]
Figure 6:
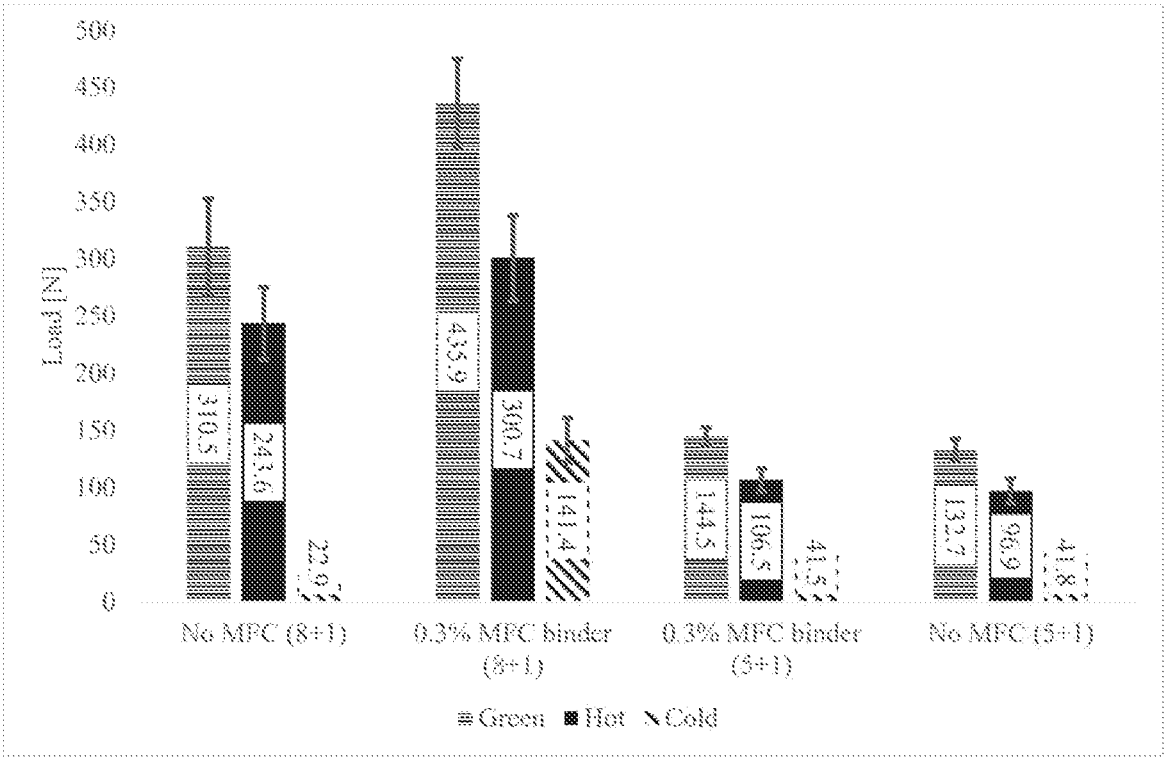
FIG. 6 is a graph showing force of break results for shells comprising 6 or 9 shell layers prepared from slurries comprising 0.3% MFC as binder, compared to conventional shells prepared from slurries comprising no MFC [n=10]

The MOR, thickness and force of break results are shown in FIGS. 4-6.

The results show a significant increase in shell thickness for the same number of coats for slurry compositions comprising 0.3% MFC, compared to the conventional slurry composition. For example, an average of about 30% increase in shell thickness for 9 coats, and about 16% increase in shell thickness for 6 coats.

The force of break is also significantly improved for shells made from slurries comprising 0.3% MFC in the binder, compared to shells made from conventional slurries. For example, on average 40% more force is required to break a green shell having 8 back up coats and 1 seal coat prepared from a slurry comprising 0.3% MFC in the binder compared to a conventional slurry that does not comprise MFC in the binder. For a hot shell, on average 23% more force is required to break the shell.

2.3 Compositions Comprising 0.4% MFC in Binder

Figure 7:
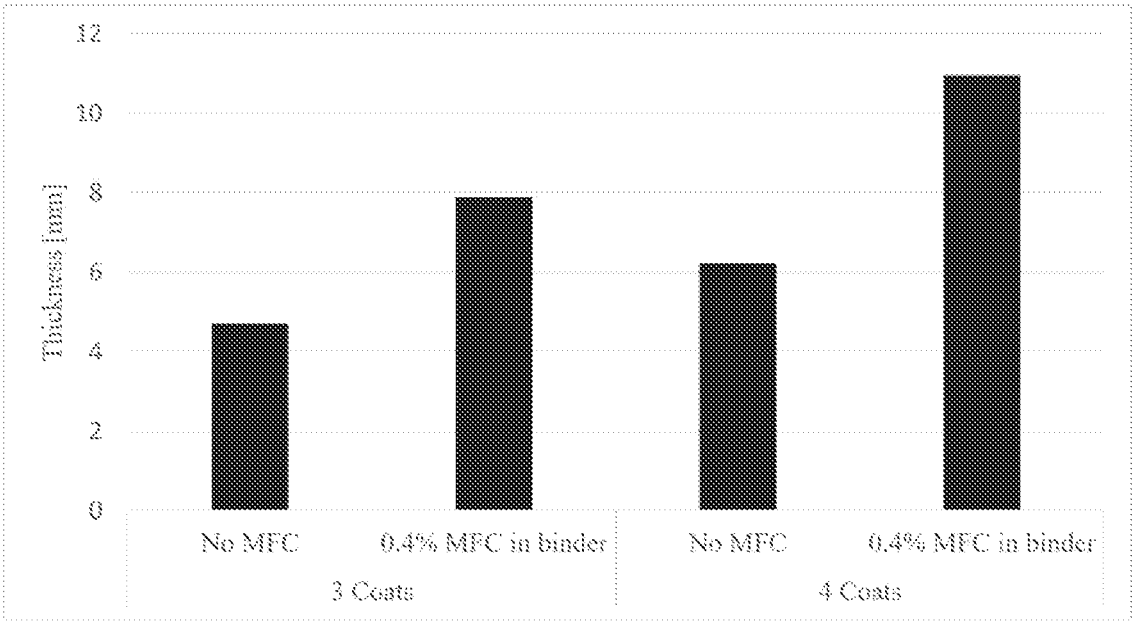
FIG. 7 is a graph comparing the shell thickness of shells fired at 1000° C., comprising 3 or 4 shell layers prepared form slurries comprising 0.4% MFC as binder, compared to conventional shells prepared from slurries comprising no MFC [n=4]

The investment casting shell formulation of Example formulation 3 was prepared, except with 0.4% MFC in the binder. The slurry produced investment casting shells with a significantly increased shell build compared to the conventional slurry, e.g. around 68% increase for 3 coats and around 76% increase for 4 coats (see FIG. 7). However, the slurry was found to have inconsistent working characteristics and did not cover the wax bars as effectively as compositions comprising 0.3% MFC in the binder.

Example 3—Permeability Testing 3.1 Sample Preparation

Example formulations 1.2 and 3 were prepared according to Table 1. Slurries of Example formulations 1 and 2 were tested at viscosities of 25 seconds and 30 seconds respectively. A conventional slurry and a slurry comprising Example formulation 3 (Table 2) was also prepared to a viscosity of 25 seconds.

The BSI (BS 1902: Section 10.2:1994) approved method for permeability testing was followed.

Five plastic ping-pong balls were attached to hollow glass rods (impervious mullite) and the junction between rod and ball sealed with wax. The ping-pong balls were then dipped in the test slurry following the dipping protocol set out in Table 7 below to form a shell and left to dry in a temperature controlled room (airflow 0.6 m/s; humidity 45% RH; temperature 25° C.).

TABLE 7

| Type of dip | Stucco used | Coats |
|---|---|---|
| Backup coat | Calcined kaolin aluminosilicate, 48% alumina (Remasil 50; 16-30 mesh; Remet UK Ltd) | 4 |
| Seal coat | None | 1 |

Each coated ball was fired up to a temperature of 1000° C., to burn out the ping-pong ball from the shell. To minimise shell cracking during the firing process, the temperature was increased using the heating ramp rate shown in Table 8.

Permeability of each shell was measured by passing nitrogen gas (1.05 PSI) through the glass rod and through the shell sample, and the flow rate was calculated in ml/min. The sample was then broken and the average thickness measured. The permeability constant (K) was calculated as follows: $K=dV/ptA$, where d is the shell thickness (cm). V is the volume of gas (ml), p is the pressure drop across the shell (cmH2O), t is time (seconds) and A is the internal area of the ball, minus the area of rod inserted ($cm^2$).

Permeability was tested immediately after firing at 1000° C. (hot). After firing, the balls were allowed to cool for 24 hours at room temperature and permeability was retested (cold).

TABLE 8

| Temperature (° C.) | Hold time minutes |
|---|---|
| 250 | 60 |
| 350 | 60 |
| 500 | 60 |
| 750 | 60 |
| 1000 | 60 |

3.2. Results

Figure 8A:
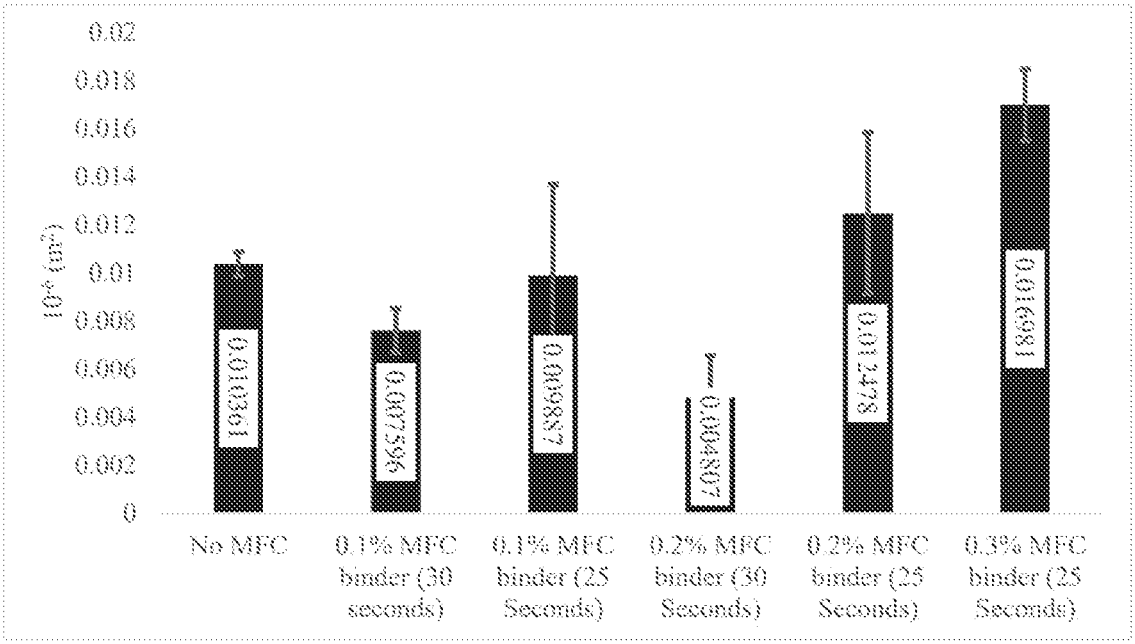
FIG. 8A is a graph showing the permeability of hot shells prepared from slurries comprising 0.1%, 0.2% and 0.3% MFC as binder at 1000° C., compared to conventional shells prepared from slurries comprising no MFC [n=5]
Figure 8B:
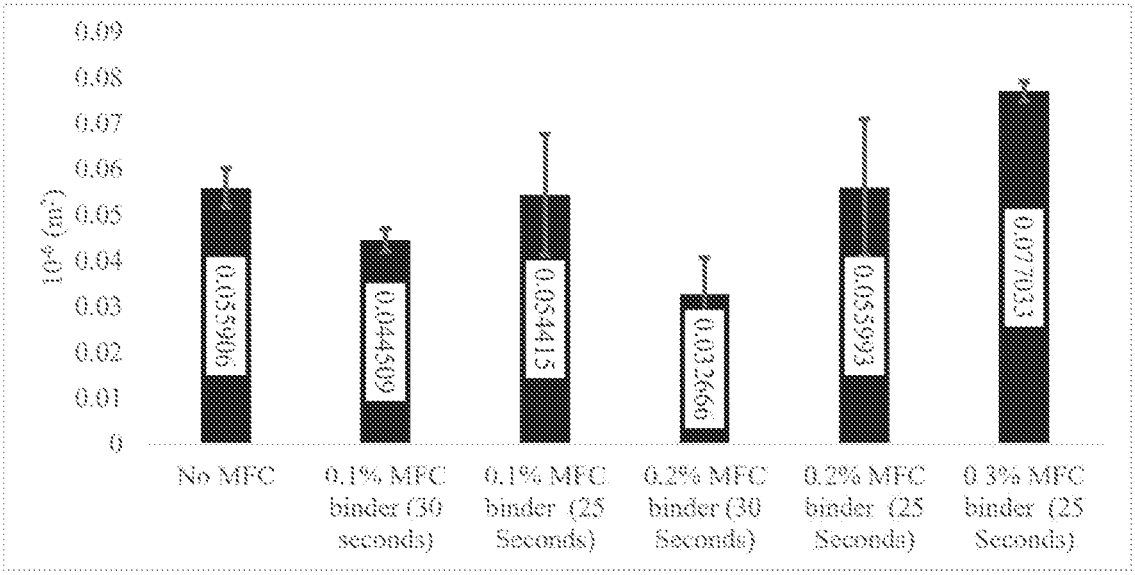
FIG. 8B is a graph showing permeability of cold shells prepared from slurries comprising 0.1%, 0.2% and 0.3% MFC as binder at room temperature after firing at 1000° C., compared to conventional shells prepared from slurries comprising no MFC [n=5]

The results of the permeability tests for the shell room trials for slurries comprising 0.1%, 0.2% and 0.3% MFC in the binder (Example formulations 1-3) compared to conventional slurries are shown in FIGS. 8A (hot) and 8B (cold).

The results show an increase in permeability for slurries of the same viscosity as the concentration of MFC increases. This result may be explained by the fact that MFC is an organic material which burns out at elevated temperatures, thus leaving voids in the shell matrix and increasing permeability in the hot and cold shells.

Figure 9:
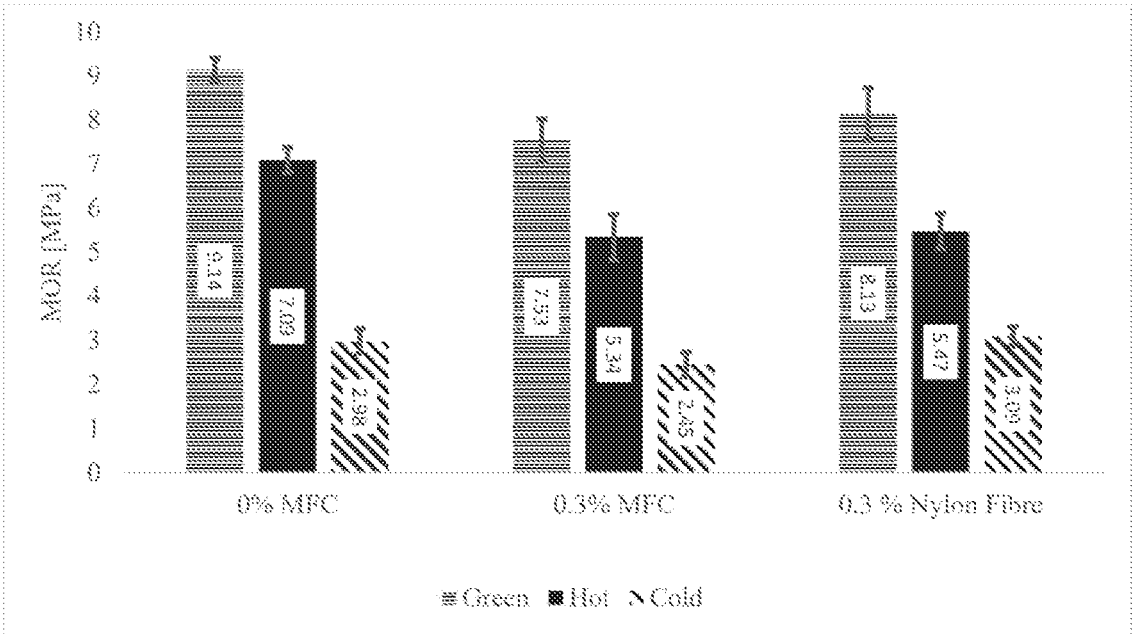
FIG. 9 is a graph showing the modulus of rupture (MOR) results for shells prepared from slurries having binder systems with 0% MFC, 0.3% MFC and 0.3% nylon fibre [n=10]
Figure 10:
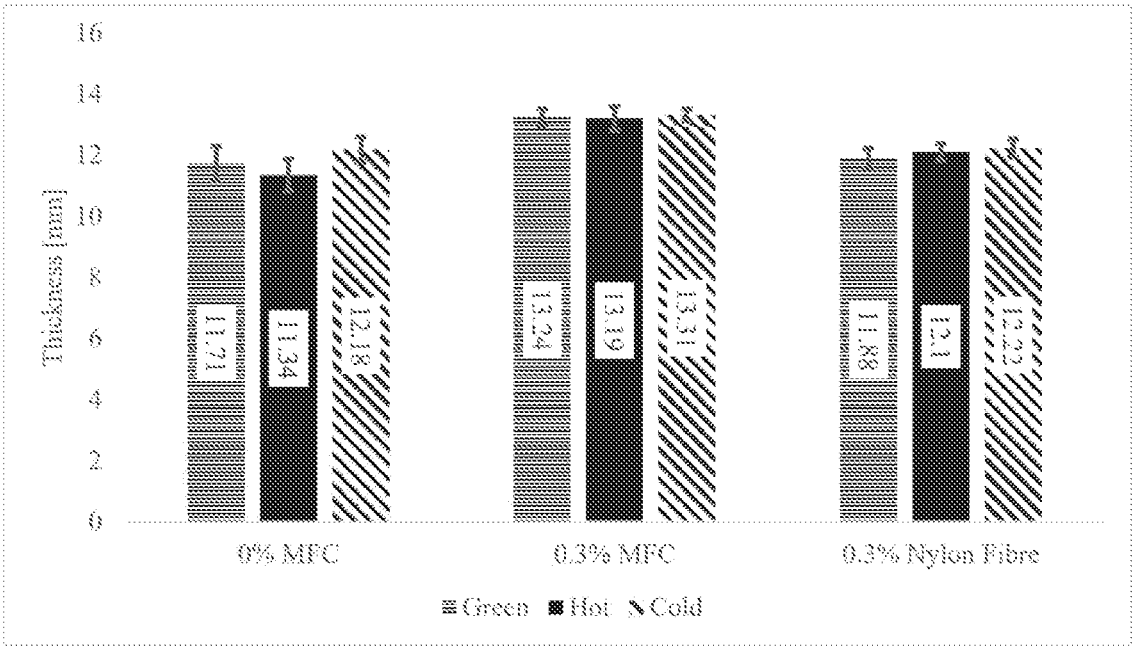
FIG. 10 is a graph showing the shell thicknesses of shells prepared from slurries having binder systems with 0% MFC, 0.3% MFC and 0.3% nylon fibre [n=10]
Figure 11:
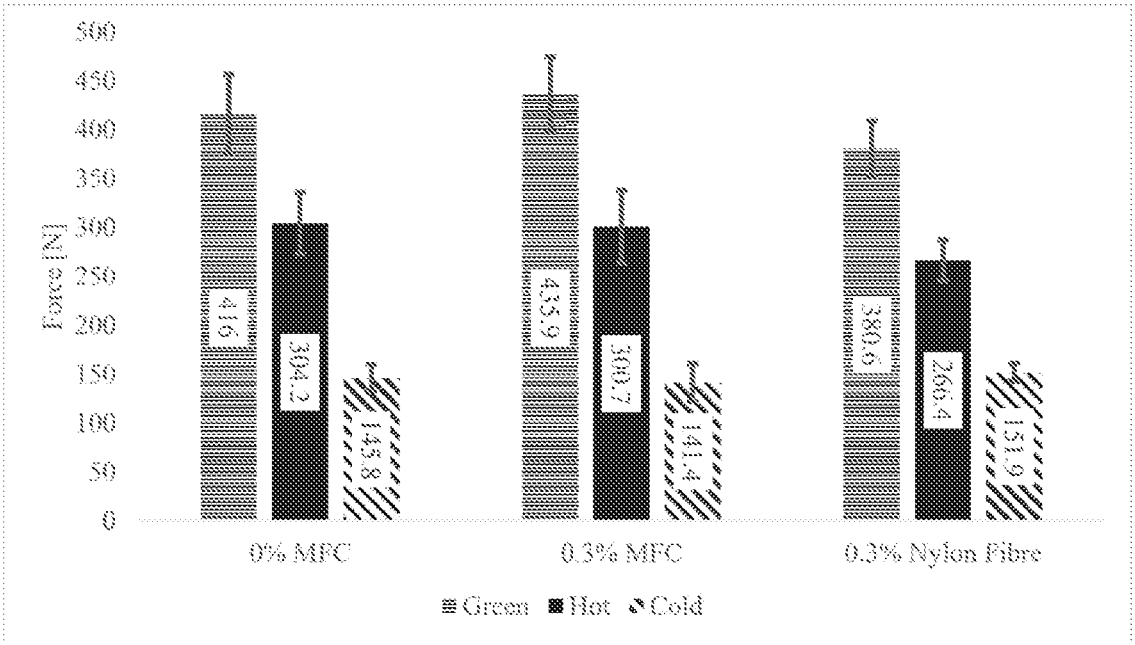
FIG. 11 is a graph showing the force of break results for shells prepared from slurries having binder systems with 0% MFC, 0.3% MFC and 0.3% nylon fibre [n=10]

Example 4—Comparison with Slurries Comprising Fibres Having a Diameter on the Micron Scale A slurry was prepared according to formulation 3, except that instead of 0.3% MFC, 0.3% of nylon fibre (12.4 kg) having an average diameter of 52 μm and an average length 0.5 mm was used. MOR, thickness and force of break measurements were taken according to the methods described in Example 2. The results are shown in FIGS. 9-11. The results show that in contrast to MFC, the addition of fibres having a diameter in the micron range does not significantly improve shell build or break strength.

Example 5—Analysis of Slurry Properties

Example formulation 3 and a conventional slurry comprising no MFC were prepared according to Table 2, and the properties of the slurries were evaluated using the protocols described below. The results are shown in Table 9.

5.1. Slurry Analysis

% total solids—a measure of all active ingredients in the slurry, i.e. all the slurry components with the water removed. The total solids in the slurry was determined using a moisture balance (Mettler MJ33). A sample of slurry was dried at 140° C., until a stable weight was achieved and the percentage of solids calculated. Alternatively, this measurement may be taken by oven drying the sample at 140° C., for around an hour and calculating the percentage solids.

Slurry density—defined as the specific gravity (SG) of the slurry, i.e. the ratio of the density of the slurry material compared to water. SG was measured using a hydrometer or by weighing a sample of slurry and comparing to a sample of water.

5.2 Binder Analysis

To test the properties of the binder in the slurry, a slurry sample was centrifuged at 4600 rpm for around 30 minutes, decanted into a fresh vial and centrifuged again at 4600 rpm for around 30 minutes. The supernatant binder was retrieved from the top of the vial. The binder properties were evaluated using the protocols described below.

% binder solids—measured in the same way as described for the "% total solids" but using a sample of the binder supernatant.

% silica—measured by loss on ignition. A sample of binder supernatant was fired at 980° C., for 60 minutes and calculating the percentage of silica residue directly. Alternatively, the percentage silica can be found by measuring the specific gravity (SG) of the binder supernatant, e.g. using a volumetric flask and a precision balance, and the SG measurement can be converted to percentage silica by looking up the conversion in the appropriate table.

% polymer solids—calculated as the difference between the binder solids at 140° C., and the percentage silica measured by loss on ignition. The "% polymer concentrate" is twice the percentage of polymer solids.

Bacteria count—measured by taking a sample of the supernatant binder, pipetting onto a culture slide and incubating at 30° C., for 48 hours. Bacterial infection, if present, would have shown on the culture slides as stains which can be compared to a standard control slide.

Binder viscosity—measured using a Brookfield Viscometer (60 rpm, 23-25° C.).

Accelerated gel test—a test to simulate accelerated aging of the slurry and therefore gelation. The binder supernatant was held at 60° C., for 48 hours in an air tight bottle (equivalent to around 1 month at room temperature). A "pass" was recorded if there was no significant change in viscosity.

5.3 Results

TABLE 9

| Test | Conventional Slurry | Example formulation 3 (0.3% MFC) | Difference |
|---|---|---|---|
| pH | 9.81 | 9.88 | 0.07 |
| Silica (%) | 27.39 | 26.81 | 0.17 |
| Binder solids (%) | 30.51 | 30.68 | 1.5 |
| Polymer solids (%) | 3.12 | 3.87 | 3.69 |
| Polymer concentrate (%) | 6.24 | 7.74 | 0.62 |
| Viscosity Zahn #4 (seconds) | 19.09 | 22.78 | 3.69 |
| Slurry solids (%) | 75.37 | 74.75 | 0.62 |
| Slurry density (g/cc) | 1.6364 | 1.6358 | 0.001 |
| Binder viscosity 60 rpm | 5.07 | 4.85 | 0.22 |
| Accelerated gel test | Pass | Pass | — |
| Bacteria count | Nil | Nil | — |

The results show that the presence of MFC in the binder increases the viscosity of the slurry significantly, with a difference of nearly 4 seconds between Example formulation 3 and the conventional slurry.

The results from the binder viscosity tests indicate that MFC material is not present in the binder after centrifugation. In contrast, casting shell binders comprising fibres having diameters on the micro to milli scale are not removed by centrifugation, thus impacting slurry testing and preventing accurate measurements.

Example 6—Warehouse Scale Method 6.1 Binder Preparation

The binder used for the preparation of Example formulation 5 (see Table 4) was prepared in the warehouse as follows.

7.2 kg of MFC was blended into deionised water (19.2 kg) using a homogeniser (SilversonX, L4RT). The blend was then decanted into two containers. A 240 kg drum was placed on a pump truck with electronic scales and 192 kg of colloidal silica (Remasol® SP30, Grace GMBH) was decanted into the drum. Using an electric stirrer (Bosch® Professional. GRW12E), the blend of MFC and deionised water was added slowly to the colloidal silica in the drum and stirred for 10-15 minutes. Adbond® BV polymer (Remet Corporation) or Lipaton SB 5843 (Synthomer plc) was then added slowly to the drum and stirring continued for a further 15-20 minutes. 1.2 kg of the anti-foaming agent, (Fumexol® 100, Huntsman Textile Effect, or Burst 100. Remet Corporation) was added and the mixture stirred for a further 5 minutes. 1.2 kg of biocide (Acticide® MBS 50:50 1,2-Benzisothiazol-3(2H)-one:2-methyl-2H-isothiazol-3-one; Thor Specialities) was then added and the mixture stirred for a further 5 minutes. Stirring was continued for another 15 minutes until the slurry was completely mixed. A sample of the binder was taken for testing.

6.2 Binder Analysis

The properties of the slurry were evaluated using the protocols described in Example 5 and the results are shown in Table 10.

TABLE 10

| Test | Example formulation 5 |
|---|---|
| pH | 10.24 |
| Silica (A) | 23.12 |
| Binder solids (%) | 28.74 |
| Polymer solids (%) | 5.62 |
| Polymer concentrate (%) | 11.24 |
| Binder density (g/cc) | 1.157 |
| Accelerated gel test | Pass |
| Bacteria count | Nil |

Example 7—Effect of Polymer Concentration

Figure 12:
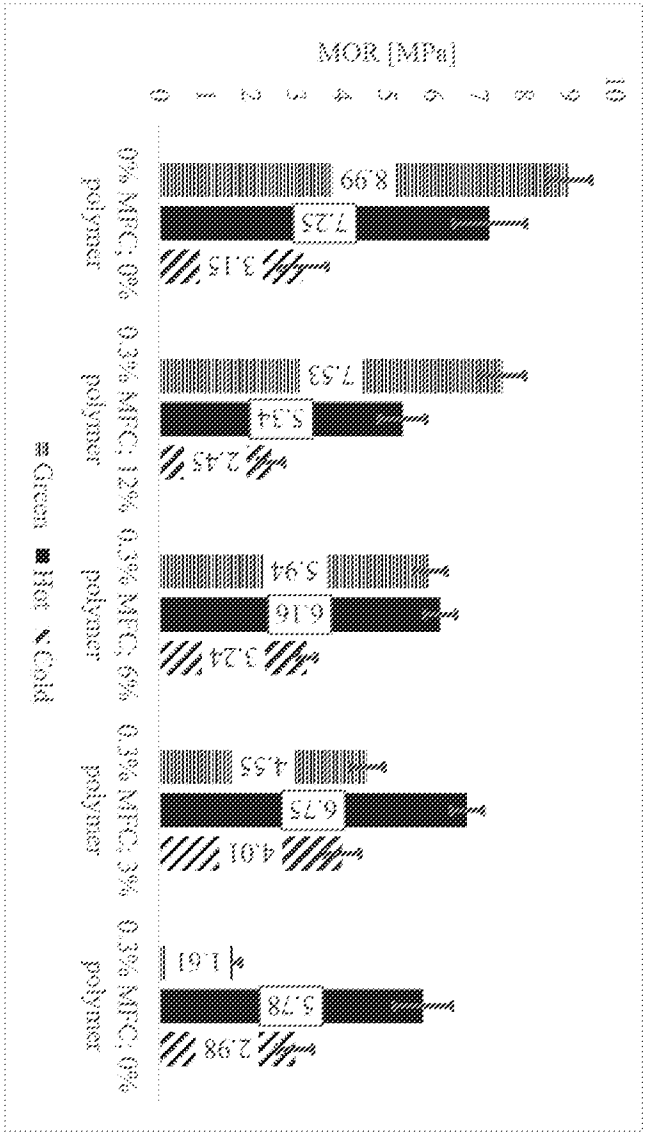
FIG. 12 is a graph showing modulus of rupture (MOR) results for shells prepared from slurries having binder systems with 0.3% MFC, in addition to 12%, 6%, 3% and 0% styrene polymer respectively [n=10]
Figure 13:
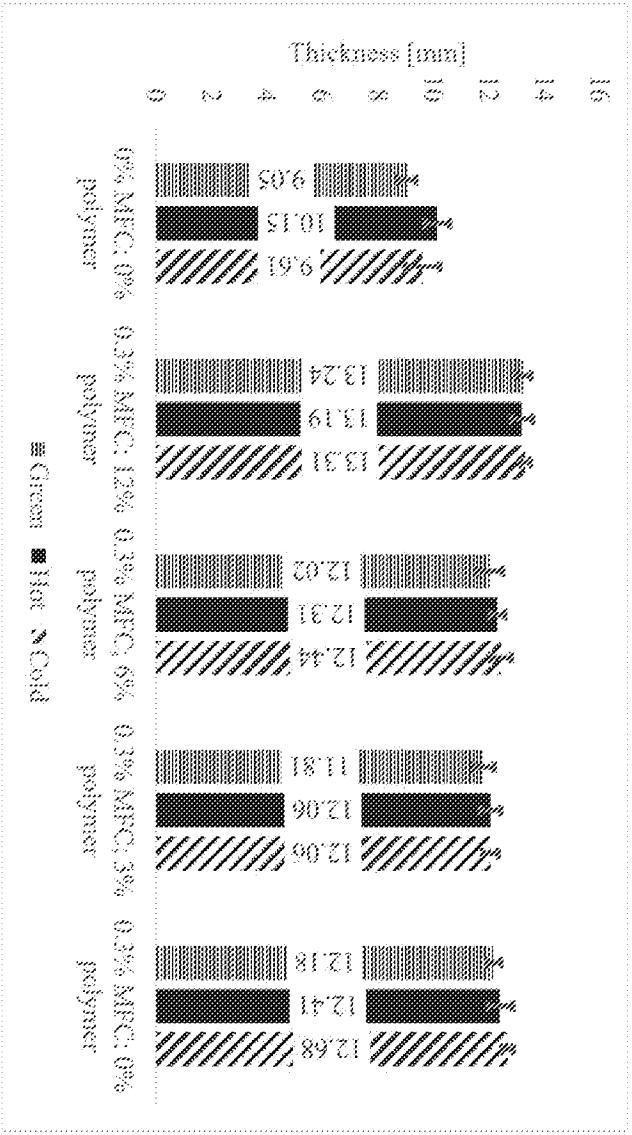
FIG. 13 is a graph comparing the shell thicknesses of shells prepared from slurries having binder systems with 0.3% MFC, in addition to 12%, 6%, 3% and 0% styrene polymer respectively [n=10]
Figure 14:
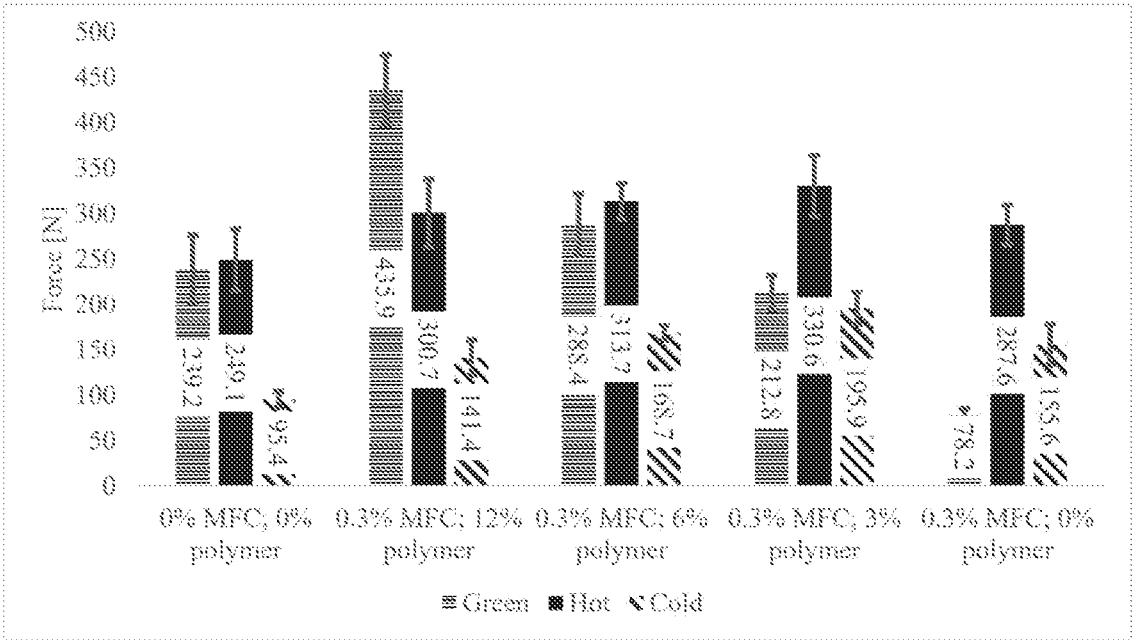
FIG. 14 is a graph showing force of break results for shells prepared from slurries having binder systems with 0.3% MFC, in addition to 12%, 6%, 3% and 0% styrene polymer respectively [n=10]

To assess the effect of the polymer concentration on shell build thickness, slurries were prepared having 6% 3% and 0% styrene butadiene polymer (Adbond® BV, Remet Corporation or Lipaton SB 5843, Synthomer plc) in the binder. MOR, shell thickness and force of break testing was carried out at green and hot (1000° C.)—see Example 2 for sample preparation and test protocols. The results are shown in FIGS. 12-14.

The results show an increase in shell thickness when the concentration of polymer is increased from 0% to 12%. The green shell force of break strength is also increased when the concentration of polymer in the binder is increased from 0% to 12%.

Example 8—Effect of the Refractory Material

Figure 15:
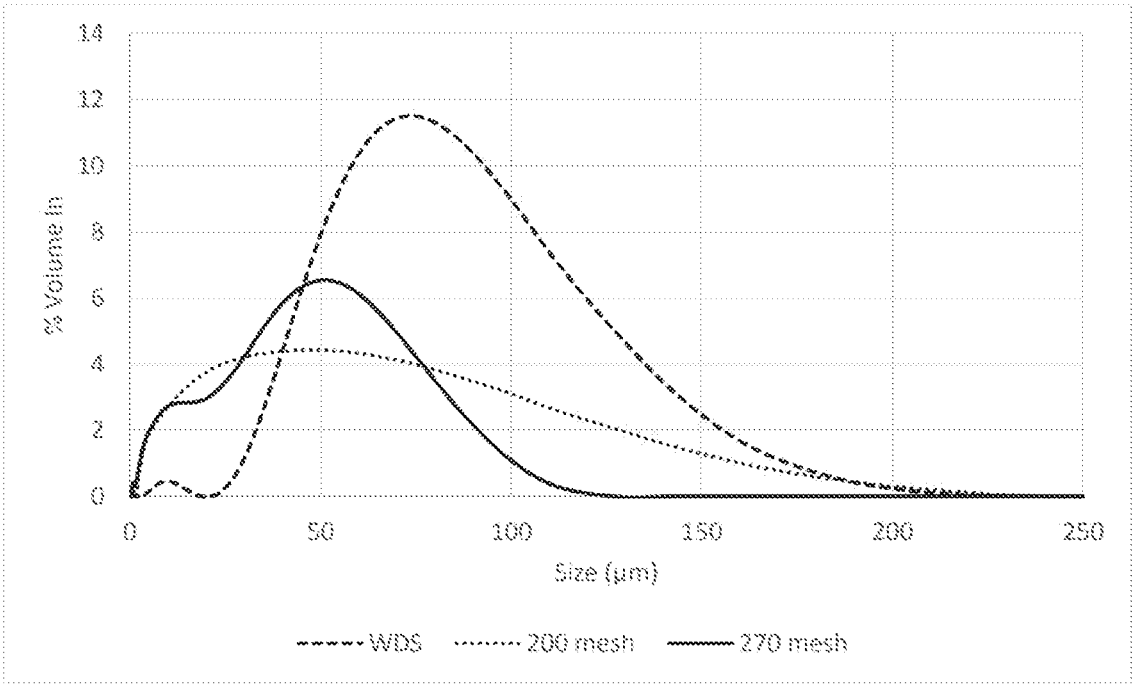
FIG. 15 shows a comparison of the particle size distributions for various fused silica refractories: 200 mesh, 270 mesh and a wide distribution fused silica refractory.

To assess the effect of the refractory material on the shell build thickness, casting shell slurries were prepared using a wide distribution silica refractory (EZ Cast™; Remet UK Ltd). The particle size distributions of fused silica 200 mesh, fused silica 270 mesh and the wide distribution fused silica are shown in FIG. 15. Particle size distributions were measured on a Malvern Mastersizer 3000.

Figure 16:
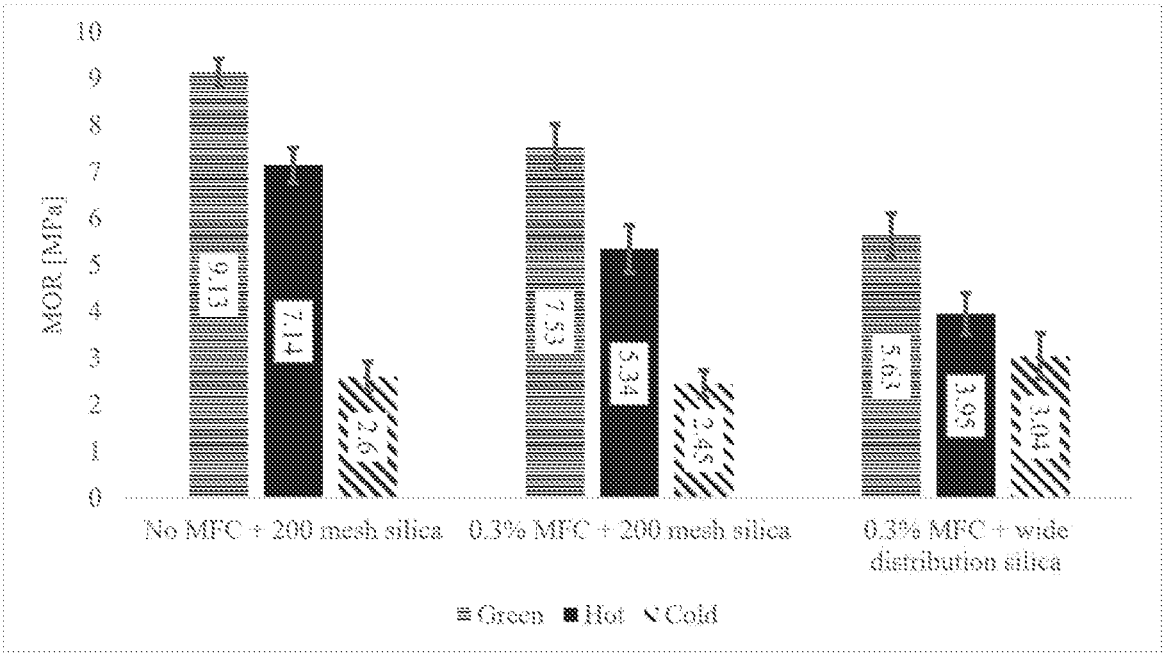
FIG. 16 shows the effect of the refractory material on the modulus of rupture (MOR) results for shells prepared from slurries comprising 0.3% MFC as binder, compared to conventional shells prepared from slurries comprising no MFC [n=10]
Figure 17:
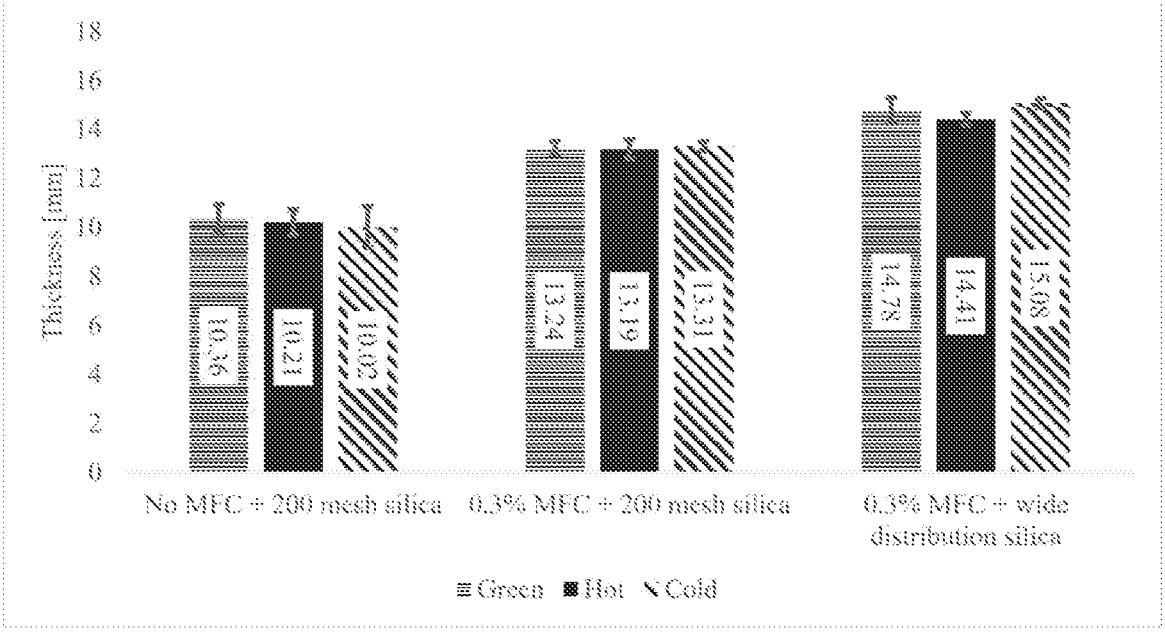
FIG. 17 shows the effect of the refractory material on shell thickness for shells prepared from slurries comprising 0.3% MFC as binder, compared to conventional shells prepared from slurries comprising no MFC [n=10]
Figure 18:
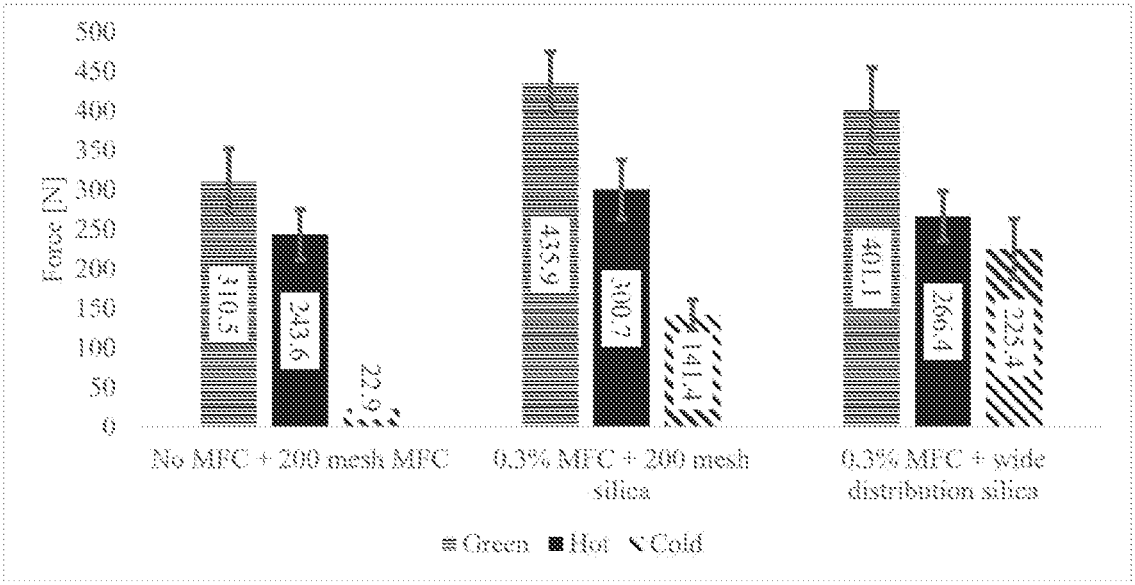
FIG. 18 shows the effect of the refractory material on the force of break results for shells prepared from slurries comprising 0.3% MFC as binder, compared to conventional shells prepared from slurries comprising no MFC [n=10]

MOR, shell thickness and force of break testing was carried out at green and hot (1000° C.)—see Example 2 for sample preparation and test protocols. The results are shown in FIGS. 16-18.

The results show that using a wide distribution silica refractory in combination with 0.3% MFC in the binder increases the shell build by over 40% compared to a conventional slurry. The force required to break the shell is also increased by up to 30% for the green shell, and up to 10/o for the hot shell.

Example 9—Binder Viscosity Testing

Figure 19:
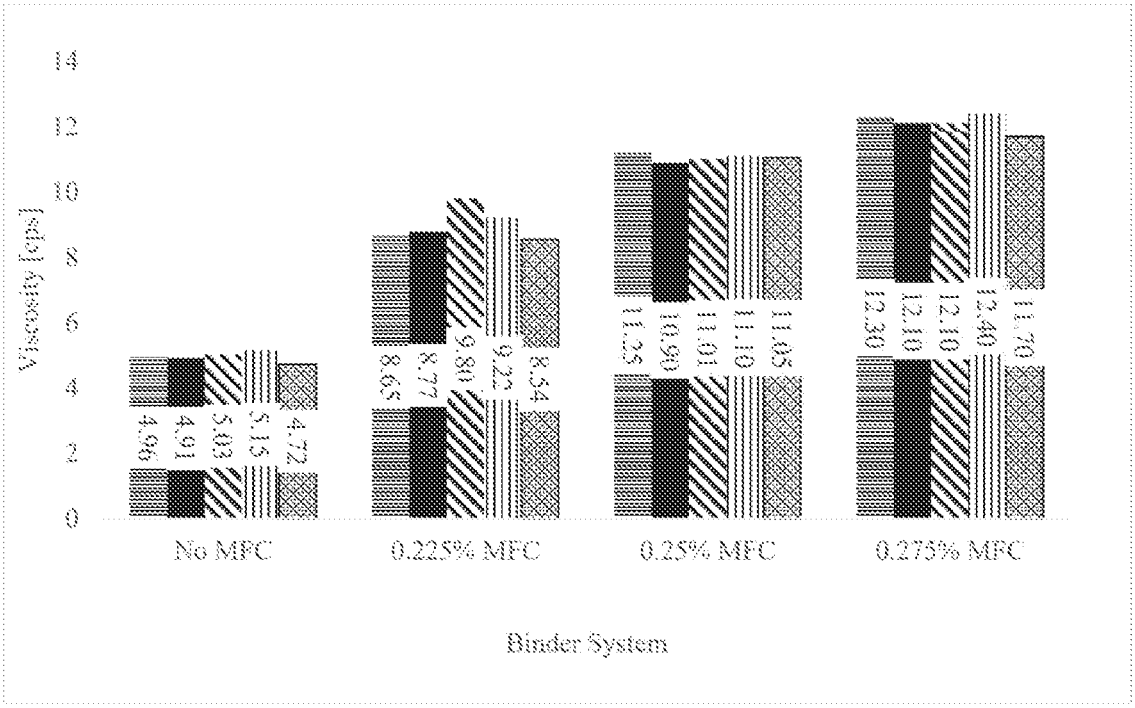
FIG. 19 shows the effect of MFC on the viscosity of various binder systems.

Binder viscosity tests were carried out to compare binders comprising varying concentrations of MFC in the binder (0%, 0.225%, 0.25% and 0.275%). The tests were repeated 5 times for each binder system and the results are shown in FIG. 19. The results show that the viscosity of the binder increases proportionally with increased concentration of MFC.

Example 10—Slurry Rheology

The effect of MFC on the rheology of investment casting shell binders was investigated. Five different binder systems were prepared as set out in Table 11.

TABLE 11

| Binder system | Binder components | Percentage amount (%) |
|---|---|---|
| Binder system 1 | Colloidal silica (Remasol ® SP-30, Grace GMBH) | 100 |
| Binder system 2 | Colloidal silica (Remasol ® SP-30, Grace GMBH) | 97 |
| | MFC (Exilva ®, P 01-V; 10%; Borregaard) | 3 |
| Binder system 3 | Colloidal silica (Remasol ® SP-30, Grace GMBH) | 88 |
| | Styrene butadiene copolymer (Lipaton SB 5843; Synthomer plc) * | 12 |
| Binder system 4 | Colloidal silica (Remasol ® SP-30, Grace GMBH) | 85 |
| | MFC (Exilva ®, P 01-V, 10%; Borregaard) | 3 |
| | Styrene butadiene copolymer (Lipaton SB 5843; Synthomer plc) * | 12 |
| Binder system 5 | Colloidal silica (Remasol ® SP-30, Grace GMBH) | 82 |
| | MFC (Exilva ®, P 01-V, 10%; Borregaard) | 3 |
| | Styrene butadiene copolymer (Lipaton SB 5843; Synthomer plc) * | 12 |
| | Wetting agent (Wet-in ®; Remet Corporation) # | 2.4 |
| | Anti-foaming agent (Burst 100; Remet Corporation) ^ | 0.6 |

* Lipaton SB 5843 may be replaced with an equal amount of Adbond ® BV (Remet Corporation).
^ Burst 100 may he replaced with an equal amount of Fumexol ® (Huntsman Textile Effect).
Wet-in ® may be replaced with an equal amount of Victawet ® 12 (ILCO Chemie).

Figure 20:
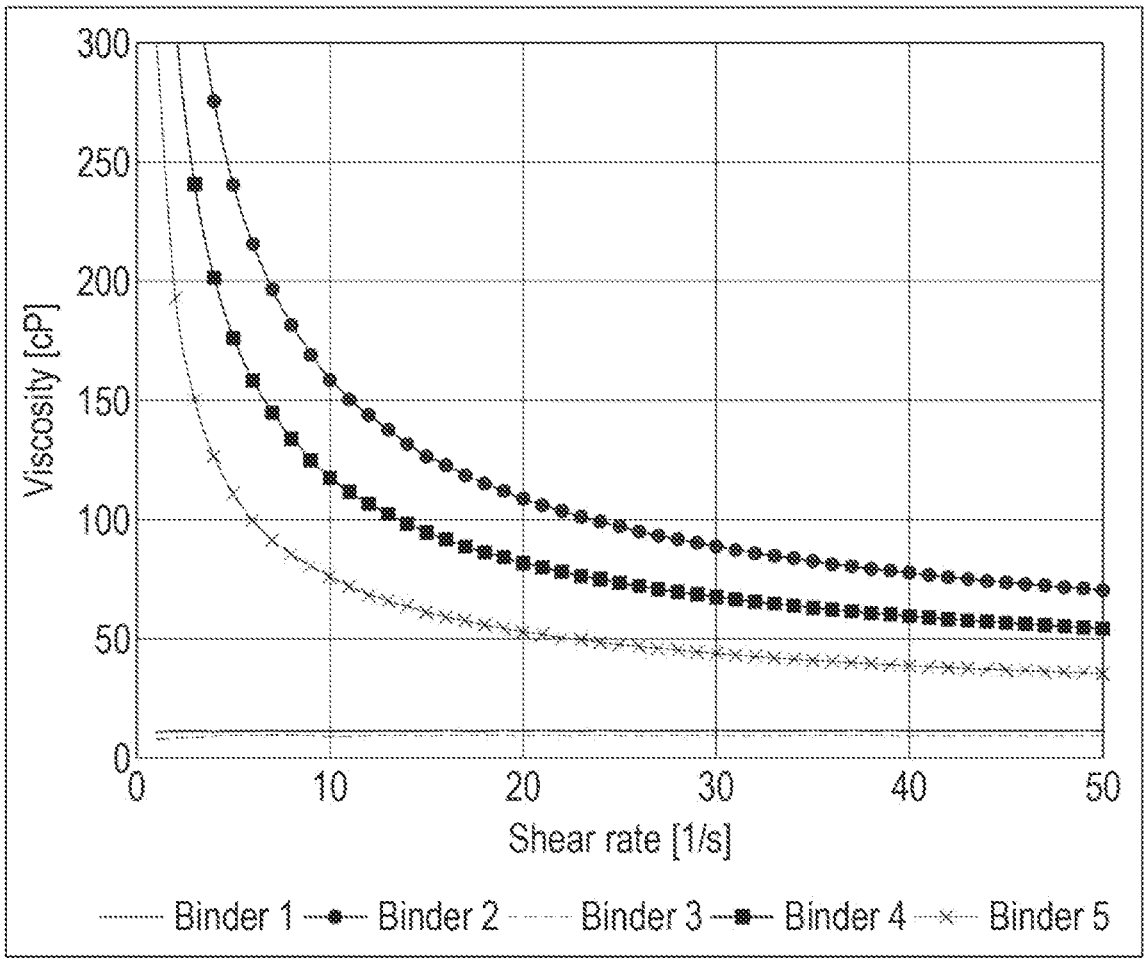
FIG. 20 shows the effect of MFC on the rheology of various binder systems.

The viscosity of the binder systems as a function of shear rate was tested using an MCR 92 rheometer (Anton-Paar GmbH). The results are shown in FIG. 20.

All of the binder systems which did not include MFC showed Newtonian or almost Newtonian behaviour. On the other hand, binder systems that included MFC showed a shear dependent drop in viscosity.

Example 11—Stability

The chemical stability of the binder used for formulation 3 comprising 0.3% MFC was compared to an equivalent binder instead comprising 0.3% of nylon fibre (average diameter 52 m; average length 0.5 mm).

The binders were subjected to an accelerated gel test, wherein the supernatant binder was placed in an air tight bottle and held at 60° C., in an oven.

The results are shown in Table 12 below.

TABLE 12

| Binder | Observations |
|---|---|
| Binder of formulation 3 (0.3% MFC) | No gelation after 71 days; no fibre drop out |
| Binder of formulation 3 (0.3% MFC replaced with 0.3% nylon fibre) | No gelation after 41 days; fibres drop out of suspension after a few hours |

Example 12—Polymer Type

Casting shell slurries of Example formulation 3 (see Example 1) were prepared with binder systems having two different styrene polymers.

Figure 21:
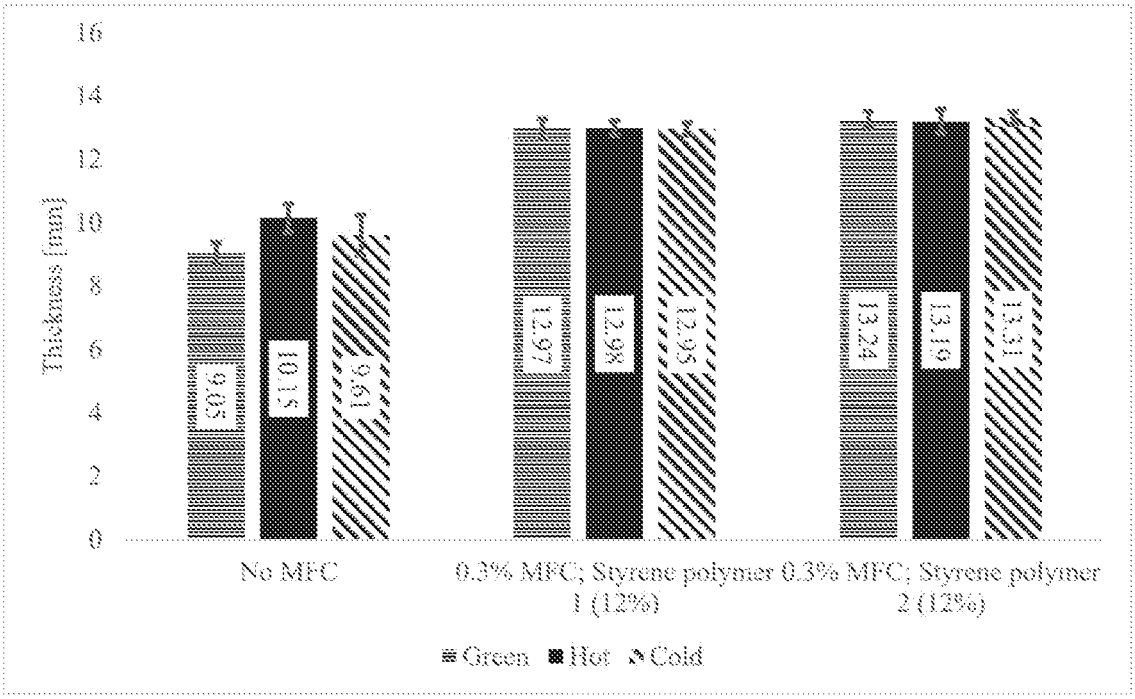
FIG. 21 is a graph comparing the shell thicknesses of shells prepared from slurries comprising binder systems with different styrene polymers compared to conventional shells prepared from slurries comprising no MFC [n=10]
Figure 22:
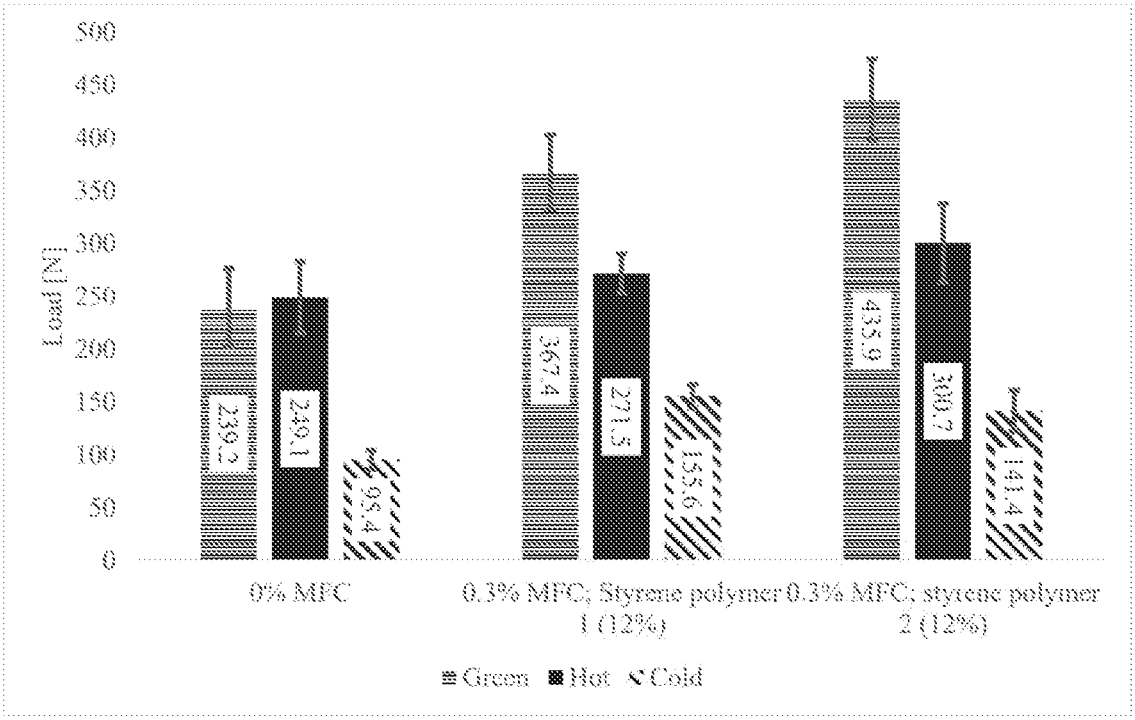
FIG. 22 is a graph showing force of break results for shells prepared from slurries comprising binder systems with different styrene polymers compared to conventional shells prepared from slurries comprising no MFC [n=10]

The thickness and force of break results are shown in FIGS. 21 and 22. Polymer is styrene acrylate polymer (Ravasol SA-1; Ravago® Chemicals Ltd). Polymer 2 is a styrene butadiene polymer (Adbond® BV Remet Corporation or Lipaton SB 5843, Synthomer plc). Both binder systems demonstrated an improvement in shell thickness and strength compared to the conventional slurry formulation with no MFC.

Example 13—Comparison of MFC with Fibrillated High-Density Polyethylene (fHDPE)

A series of three casting shell slurries were Compared. The tested slurries are those setout in Table 13.

TABLE 13

| Ingredients | No fibrils slurry (g) | MFC slurry (g) | fHDPE slurry (g) |
|---|---|---|---|
| 200 mesh fused silica (Imerys Fused Minerals) | 700 | 700 | 700 |
| Colloidal silica (Remasol ® SP-30; Grace GMBH) | 350 | 350 | 350 |
| Styrene butadiene copolymer (Lipaton SB 5843; Synthomer plc)* | 50 | 50 | 50 |
| Wetting agent (Victawet ® 12; ILCO Chemie) | 10 | 10 | 10 |
| Anti-foaming agent (Burst 100; Remet Corporation) | 2.5 | 2.5 | 2.5 |
| Fibrils | None | 12.4 (MFC) | 1.24 (fHDPE) |

MFC refers to Exilva ® P 01-V, 10% concentration obtained from Borregaard.

*Lipaton SB 5843 may be replaced with an equal amount of Adbond ® BV (Remet Corporation).

Victawet ® 12 may be replaced with an equal amount of Wet-in ® (Remet Corporation).

fHDFP refers to Short Stuff® Fibrillated HDPE fibres (#ESS50F) obtained from Minifibers Inc. Johnson City TN, USA. Short Stuff® fibres (#ESS50F) have an average fibre length of ~0.1 mm and a diameter of 5 μm. Also available are Short Stuff® fibres (#ESS5F), which also have an average fibre length of ~0.1 mm and a diameter of 5 μm, which are said to have reduced dispersion in low shear aqueous systems.

Figure 23:
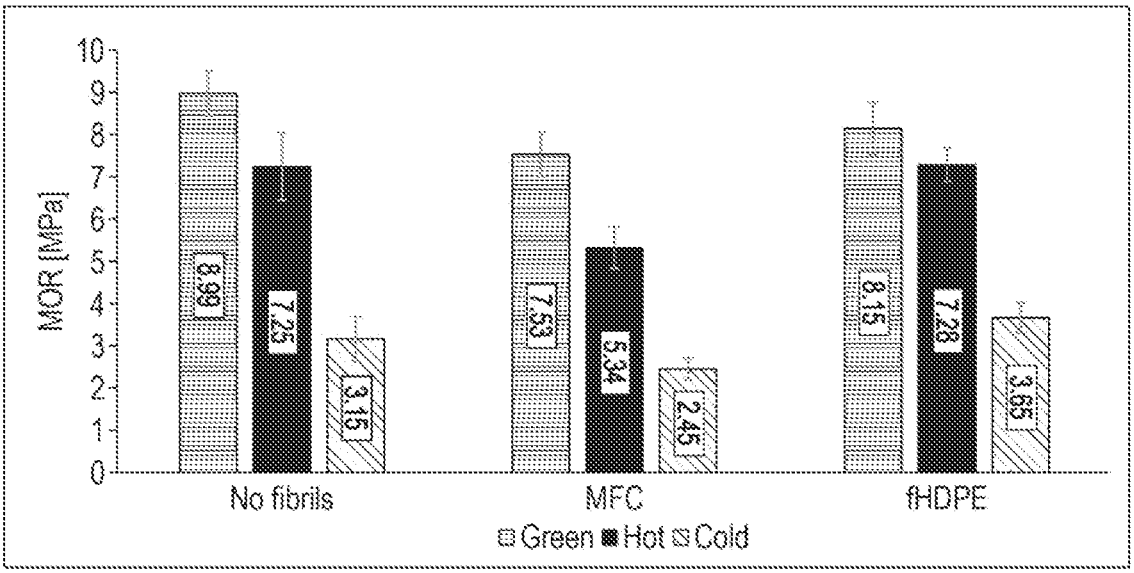
FIG. 23 shows the MOR results for shells made with no fibrils slurry, MFC slurry and fHDPE slurry [n=10]
Figure 24:
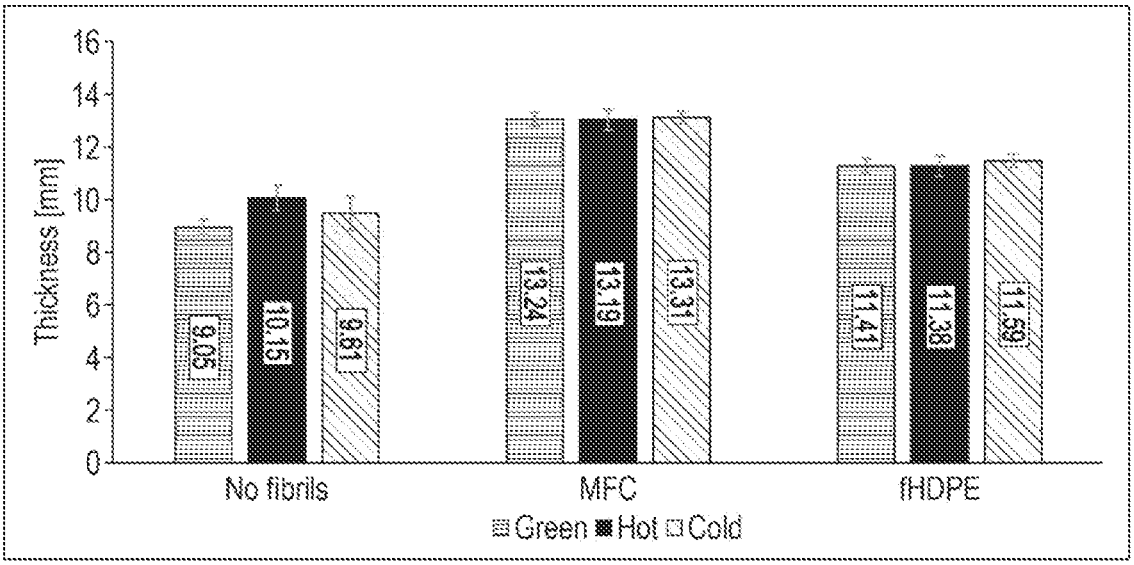
FIG. 24 shows the thickness results for shells made with no fibrils slurry, MFC slurry and fHDPE slurry [n=10]
Figure 25:
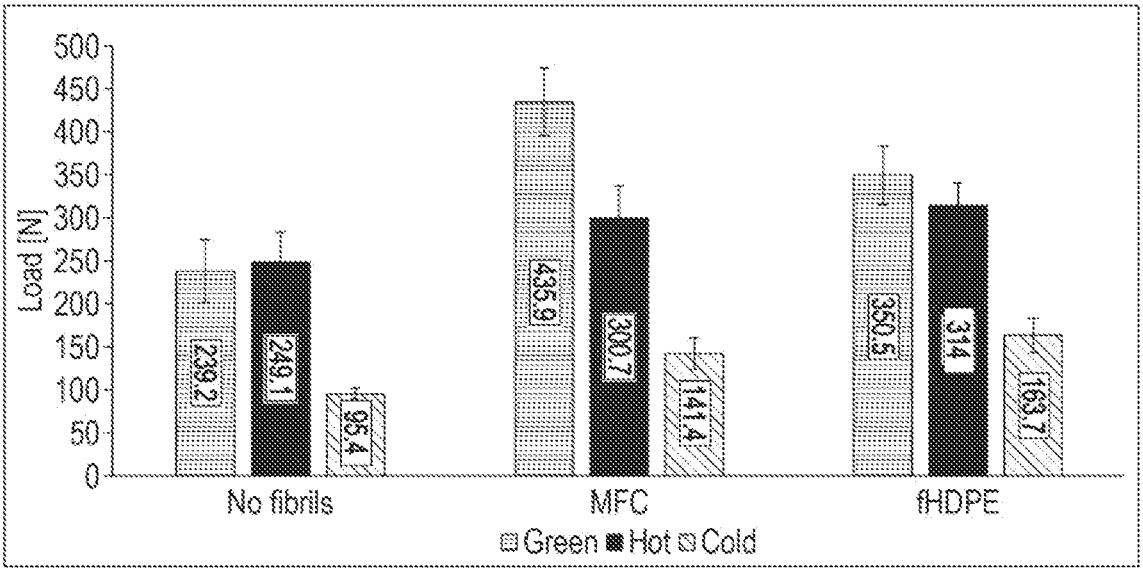
FIG. 25 shows the break force results for shells made with no fibrils slurry, MFC slurry and fHDPE slurry [n=10]

MOR testing was carried according to Example 2, section 2.1. The MOR, thickness and force of break results are shown in FIGS. 23-25.

Results from the MOR testing demonstrated that there was no improvement on MOR strength when fHDPE was added to the slurry without fibrils. A small increase in the thickness of the shell build can be seen with a slurry with fHDPE compared to a slurry without fibrils, but this increase is not as significant as the increase seen with the slurry with MFC.

The properties of the three slurries were analysed according to Example 5. The results are shown in Table 14.

TABLE 14

| Test | No fibrils slurry | MFC slurry | fHDPE slurry |
|---|---|---|---|
| pH | 9.81 | 9.88 | 10.09 |
| Silica % | 27.39 | 26.81 | 27.47 |
| Binder solids (%) | 30.51 | 30.68 | 31.06 |
| Polymer Solids (%) | 3.12 | 3.87 | 3.59 |
| Polymer Concentrate (%) | 6.24 | 7.74 | 7.18 |
| Viscosity (Seconds) Zahn #4 | 19.09 | 22.78 | 20.97 |
| Slurry Solids (%) | 75.37 | 74.75 | 75.02 |
| Slurry Density (g/cc) | 1.6364 | 1.6358 | 1.6102 |
| Accelerated Gel Test | Pass | Pass | Pass |
| Bacteria Count | Nil | Nil | Nil |

The results suggest that the MFCs are centrifuged out along with the refractory material. This can be seen as the binder results between the no fibrils slurry and the MFC slurry were consistent. The MFC and fHDPE fibres both increased the viscosity providing a difference of nearly 4 seconds between the no fibrils slurry and the MFC slurry, and nearly 2 seconds between the no fibrils slurry and the fHDPE slurry.

Figure 26:
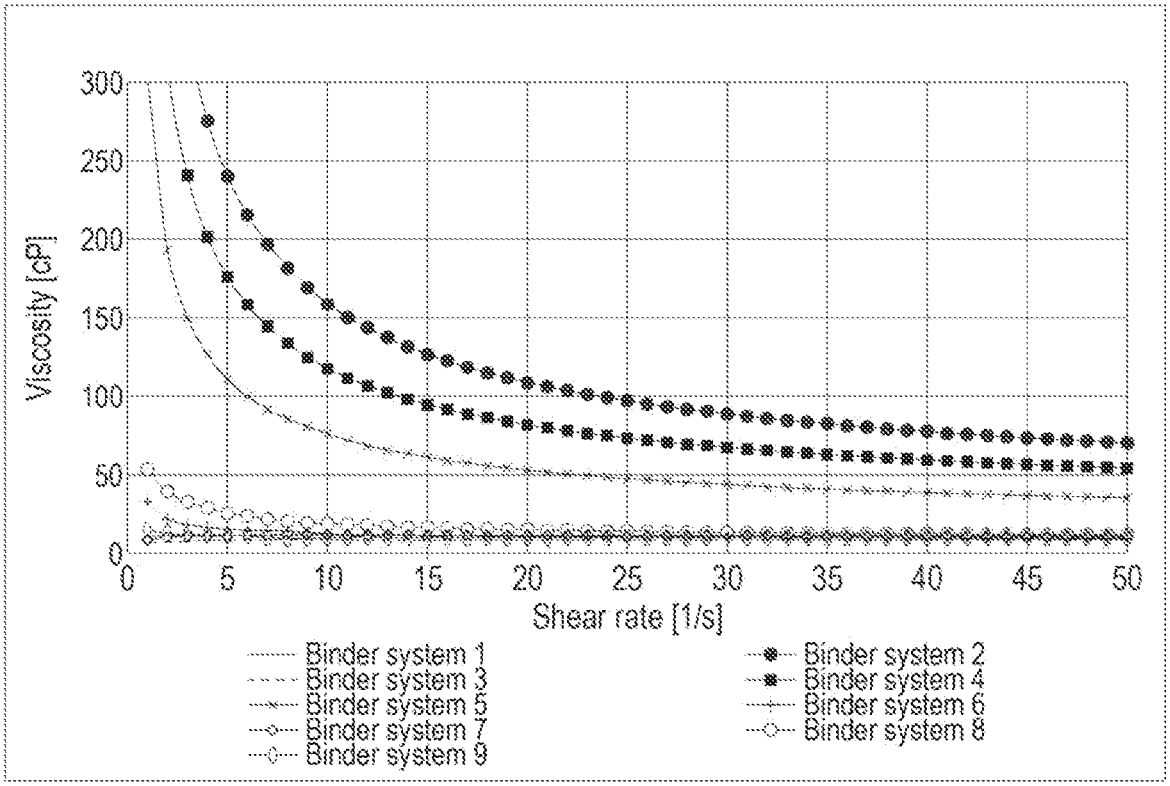
FIG. 26 shows the effect of addition of fHDPE or MFC on the shear rate-dependent viscosities of various binder systems.

FIG. 26 illustrates the viscosities of the binder samples prepared as a function of shear rate. Binders 1-5 are as set out in Table 11. Binders 6-9 are as set out in Table 15.

TABLE 15

| Binder system | Binder components | Percentage amount (%) |
|---|---|---|
| Binder system 6 | Colloidal silica (Remasol ® SP-30, Grace GMBH) | 99.7 |
| | fHDPE (Short Stuff ® Fibrillated HDPE fibres; # ESS5F; Minifibers, Inc) | 0.3 |
| Binder system 7 | Colloidal silica (Remasol ® SP-30, Grace GMBH) | 99.7 |
| | fHDPE (Short Stuff ® Fibrillated HDPE fibres; # ESS50F; Minifibers, Inc) | 0.3 |
| Binder system 8 | Colloidal silica (Remasol ® SP-30, Grace GMBH) | 87.7 |
| | Styrene butadiene copolymer (Lipaton SB 5843; Synthomer plc) * | 12 |
| | fHDPE (Short Stuff ® Fibrillated HDPE fibres; # ESS5F; Minifibers, Inc) | 0.3 |
| Binder system 9 | Colloidal silica (Remasol ® SP-30, Grace GMBH) | 87.7 |
| | Styrene butadiene copolymer (Lipaton SB 5843; Synthomer plc) * | 12 |
| | fHDPE (Short Stuff ® Fibrillated HDPE fibres; # ESS50F; Minifibers, Inc) | 0.3 |

* Lipaton SB 5843 may be replaced with an equal amount of Adbond ® BV (Remet Corporation).

FIG. 26 shows that the addition of fHDPE fibres to SP30 results in a limited increase in viscosity at very low shear rates. However, this effect is not nearly as apparent when compared to the addition of MFC to SP30, where the binder mixture showed obvious shear thinning behaviour. Furthermore, the addition of styrene butadiene copolymer to the mixtures containing fHDPE seemed to eliminate the viscosity-modifying effect contributed by the fHSPE fibres, whereas SP30 mixtures containing MFC and styrene butadiene copolymer are able to retain their shear thinning properties.

Figure 27:
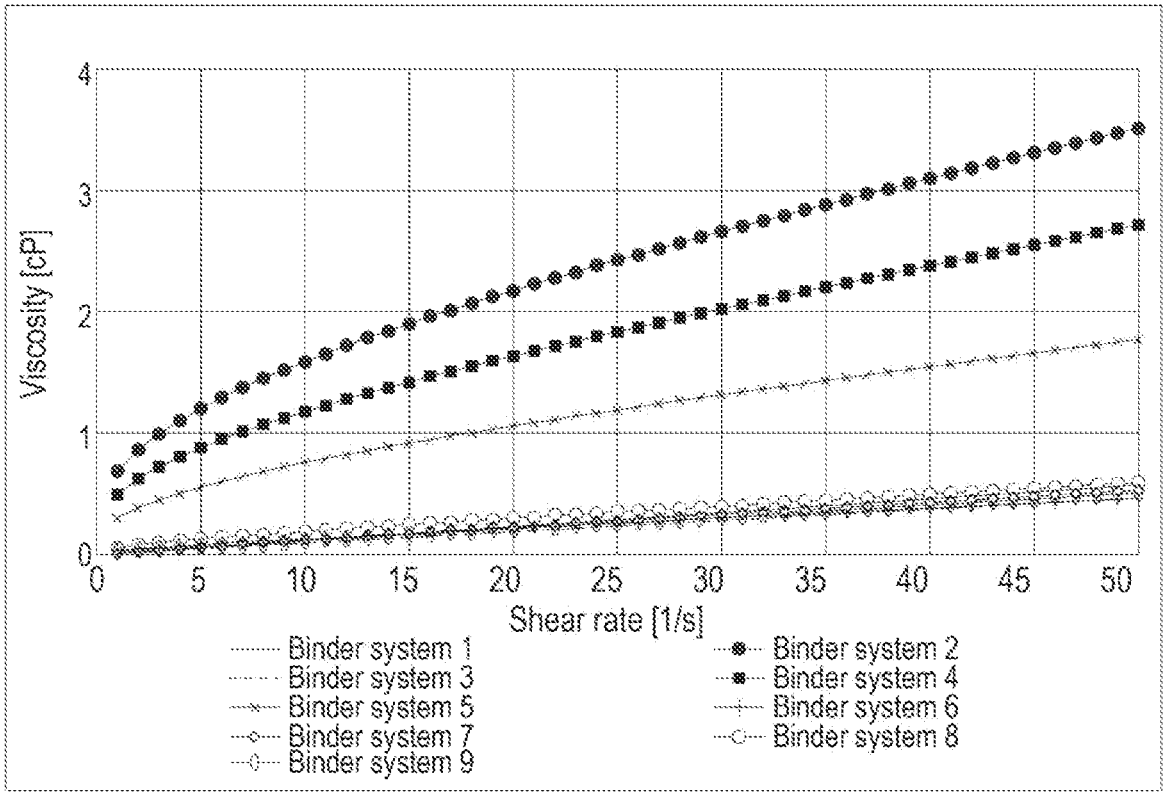
FIG. 27 shows the effect of addition of fHDPE or MFC on the relationship between shear stress and shear rate for various binder systems.

FIG. 27 shows plots of shear stress vs shear rate for the binder samples. The data show that all the samples containing fHSPE fibres exhibited Newtonian or almost Newtonian behaviour, whereas samples with MFC exhibited a more pseudoplastic or shear thinning behaviour.

The invention claimed is:

1. An investment casting shell composition comprising a refractory component and a binder, the binder comprising hydrophilic fibrils having an average diameter greater than 1 nm and less than 1 μm, wherein the hydrophilic fibrils comprise microfibrillated cellulose (MFC).

2. The composition according to claim 1, wherein the hydrophilic fibrils have an average diameter between 10 nm to less than 1 μm.

3. The composition according to claim 1, wherein the hydrophilic fibrils are present in an amount from about 0.1 wt % to about 20 wt % based on the total mass of the binder.

4. The composition according to claim 1 further comprising at least one additional polymer, wherein the at least one additional polymer comprises one or more monomers selected from: acrylic acid, acrylic esters, methacrylic acid, methacrylic esters, styrene, butadiene, vinyl chloride, vinyl acetate, and combinations thereof.

5. The composition according to claim 1, wherein the hydrophilic fibrils in the binder are present in an amount from about 0.01 wt % to about 1 wt % based on the total mass of the composition.

6. The composition according to claim 1, wherein the refractory component comprises fused silica selected from: fused silica mesh 120, fused silica mesh 140, fused silica mesh 170, fused silica mesh 200, fused silica mesh 270, fused silica mesh 325, and combinations thereof.

7. The composition according to claim 1, wherein the refractory component comprises a wide distribution fused silica, wherein the wide distribution fused silica comprises a combination of 85% fused silica 50-80 mesh and 15% fused silica 120 mesh.

8. An investment casting shell prepared from the composition according to claim 1.

9. An investment casting method for creating an article, the method comprising coating an expendable preform with at least one coat of an investment casting shell slurry, wherein at least one of the slurry coats comprises the investment casting shell composition according to claim 1.

10. The investment casting method according to claim 9, wherein the slurry coats in the second layer and above comprise the investment casting shell composition.

11. The investment casting method according to claim 9, further comprising stuccoing one or more of the at least one slurry coats, wherein a slurry coat and a stucco coat produced by the stuccoing create a shell layer, wherein each shell layer once dried is at least 1 mm thick.

12. A kit for preparing an investment casting shell composition comprising:

the compositionaccording to claim 1.

13. The binder according to claim 1, wherein the hydrophilic fibrils have an average diameter between 1 nm to less than 900 nm.

14. The binder according to claim 1, wherein the hydrophilic fibrils have an average diameter between 10 nm to less than 900 nm.

* * * * *